US006440357B1

(12) United States Patent
Hinzmann

(10) Patent No.: US 6,440,357 B1
(45) Date of Patent: Aug. 27, 2002

(54) COMPACTED-POWDER OPPOSED TWIN-HELICAL GEARS AND METHOD

(75) Inventor: Gerd Hinzmann, Oakville (CA)

(73) Assignee: Stackpole Limited, Mississauga (CA)

( * ) Notice: Subject to any disclaimer, the term of this patent is extended or adjusted under 35 U.S.C. 154(b) by 0 days.

(21) Appl. No.: 09/372,604

(22) Filed: Aug. 12, 1999

Related U.S. Application Data

(63) Continuation-in-part of application No. 08/647,057, filed on May 9, 1996, now Pat. No. 6,165,400.

(51) Int. Cl.[7] ..... B22F 3/02
(52) U.S. Cl. ..... 419/66; 425/78
(58) Field of Search ..... 419/66; 425/78

(56) References Cited

U.S. PATENT DOCUMENTS

| | | | |
|---|---|---|---|
| 2,561,735 | A | 7/1951 | Haller |
| 3,020,589 | A | 2/1962 | Maritano |
| 3,394,432 | A | 7/1968 | Laurent |
| 3,694,127 | A | 9/1972 | Takahashi et al. |
| 3,752,622 | A | 8/1973 | Viadana |

(List continued on next page.)

FOREIGN PATENT DOCUMENTS

| | | |
|---|---|---|
| EP | 0528761 A1 | 6/1992 |
| JP | 09176701 | 7/1997 |

OTHER PUBLICATIONS

U.S. application No. 08/647,057, filed May 9, 1996.

*Primary Examiner*—Mary Lynn Theisen
(74) *Attorney, Agent, or Firm*—John R. S. Orange; Orange & Chari

(57) ABSTRACT

A multiple-acting powder metal press is disclosed for making green form double helical gear compacts. The press has inner and outer lower punches, and an upper, outer punch. The upper and lower outer punches have left hand and right hand external helical profiles as chosen to produce a desired helical gear. The punches co-operate with left hand and right hand helical dies carried by the press about the punches. The helical faces require that the dies rotate relative to the punches during operation. A cam and roller mechanism may drive this rotation.

The compact forming process commences with an open position in which powder is introduced to a vacant lower die cavity. The upper portions of the press advance downward to close the cavity. All parts of the press except the lower inner, or transfer, punch then move downward at the same speed to transfer powder to the extremities of the cavity. When transfer is complete both lower punches may be stopped, while the upper punches continue to advance. The dies advance at half the speed of the upper punches, rotating partially as they do so. Once the powder reaches its compacted density the upper and lower punches cease motion, but the dies continue to turn, separating themselves and compressed part. Finally the part is ejected and the press returns to the initial condition.

28 Claims, 21 Drawing Sheets

U.S. PATENT DOCUMENTS 3,773,446 A 11/1973 Borrini
3,842,646 A 10/1974 Kuhn
3,891,367 A 6/1975 Signora
3,909,167 A 9/1975 Signora
4,008,021 A 2/1977 Fedrigo et al.
4,043,385 A 8/1977 Petrenchik
4,047,864 A 9/1977 De Santis
4,053,267 A 10/1977 De Santis
4,061,452 A 12/1977 De Santis
4,061,453 A 12/1977 De Santis
4,087,221 A 5/1978 Munson et al.
4,153,399 A 5/1979 De Santis
4,270,890 A 6/1981 Otti
4,401,614 A 8/1983 De Santis
4,482,307 A 11/1984 Schaidl et al.
4,573,895 A 3/1986 De Santis
4,666,389 A 5/1987 Relis et al.
4,853,180 A 8/1989 Howard
4,923,382 A 5/1990 Klein
5,024,811 A 6/1991 Hinzmann et al.
5,043,111 A 8/1991 Hinzmann et al.
5,043,123 A 8/1991 Gormanns et al.
5,049,054 A 9/1991 Schaidl et al.
5,156,854 A 10/1992 Yamada
5,238,375 A 8/1993 Hirai
5,259,744 A 11/1993 Take
5,326,242 A 7/1994 Katagiri et al.
5,366,363 A 11/1994 Good et al.
5,401,153 A 3/1995 Katragiri et al.
5,478,225 A 12/1995 Takeuchi et al.
5,498,147 A 3/1996 Katagiri et al.
5,698,149 A 12/1997 Hinzmann et al.

Sheet 1 of 3.

Sheet 2 of 3.

Sheet 3 of 3.

Sheet 1 of 2.

Sheet 2 of 2.

COMPACTED-POWDER OPPOSED TWIN-HELICAL GEARS AND METHOD

RELATED APPLICATION

This application is a continuation-in-part of U.S. application Ser. No. 08/647,057, now U.S. Pat. No. 6,165,400 filed on May 9, 1996.

FIELD OF INVENTION

This invention relates to the field of compacting presses for powder materials, and in particular to such presses as are used to compact powder metal into the form of gears, helical gears, and most particularly to opposed double helical, or herringbone, gears.

BACKGROUND OF INVENTION

Powder compacting presses have been known for many years. They typically involve at least three interacting pans: a die, an upper punch and a lower punch. Initially the top punch is separated from the die and powder is introduced into a cavity formed within the die above the lower punch. Subsequent motion of the opposed punches reduces the internal cavity volume to compress the powdered metal to desired density. The resulting green formed pan is removed from the cavity and sintered. For a part having sections of differing thickness additional movable top or bottom punches may be added to promote transfer of powder within the cavity.

The manufacture of gear teeth is more difficult when a helical gear is desired. Unlike a simple spur gear, as the die for a helical gear is closed it must also rotate relative to the punch, and then must achieve relative rotation in the opposite direction to release the compacted pan. Where the helix angle is shallow, and the thickness of the gear is modest, an externally helically threaded punch is, or opposed punches are, brought into a mating, internally helically threaded die under the pressure of longitudinally acting rams. The die and one punch or both punches are carried in bearings and the force of the ram acting against the threads causes the tool elements (i.e. die and punch or both punches) to auto-rotate. Auto-rotating helical tool elements (i.e. die and punch or both punches) are known, as for example in U.S. Pat. No. 3,694,127 to Takahashi et al., and U.S. Pat. No. 5,259,744 to Take.

When the helix angle or the thickness of the gear increases, the frictional resistance in such dies may become large. To overcome this friction it is known to use motors to apply a torque to the tool elements, or to cause rotation of the tool elements at an appropriate speed, given the helix angle, as longitudinal rams force the tool elements together. It is also known that if one wishes to make parts having keyways or eccentric bores or internal splines there must be no relative rotation of the punch or core feature relative to the compacted powder, since such motion would shear off the keyway or bore.

Powder metal gears with offset, phased or undercut upper and lower portions have been produced. In these cases the finished pans can comprise at least two gear profiles formed in opposing dies which separate on a parting plane. In the case of helical gears it would be advantageous to be able to produce a gear having a helical profile to one side of the parting plane of the dies, and a different profile to the other side, whether an opposed helix, a helix of different pitch of the same hand, or out of phase helix, or a spur gear, whether of the same diameter or tooth height or not. A typical application of this kind of technology relates to the production of symmetrical opposed helical gears, most often referred to as herringbone gears.

It is advantageous to make herringbone gears from compacted and sintered powder metal since it is difficult and expensive to machine herringbone gears in the conventional manner. Conventional powder metallurgy may instead require back to back placement and juncture of two opposite-handed helical gears. This limits the sire and delicacy of the metal herringbone gears that can be manufactured, and also their quality. If welded together such gears may not be true. If mechanically fastened such gears may be unnecessarily bulky.

To date the inventor is unaware of any powder metal presses for producing double opposed helical, or herringbone, gears. U.S. Pat. No. 3,694,127 to Takahashi et al. shows, at FIGS. 11 and 12, a powder metal compact and tooling for opposite handed helical threads. This apparatus cannot be used to produce herringbone gears, or even opposite handed gears in which the diameter of the gears is close, since, as noted in U.S. Pat. No. 5,259,744 to Take, the outer lower punch wall becomes too thin. Experience suggests that the minimum die wall thickness required to make a reliable tool is about 2 mm., which with allowance for the dedendum of the larger gear and the addendum of the smaller gear, would limit the parts which can be produced. The Takahashi device also relies on auto-rotation to move the upper punch, die, and lower outer punch all at once. Take can be used to make two helical gears of the same hand, but once again cannot make herringbone gears and is limited to producing helical gears that vary in diameter by at least the height of the teeth to be produced.

Thus there is a need for a device and method for compacting powder to form opposed twin helical gears that avoids thin walled punches. Further, there is a need for a device and method capable of compacting powder not only to form herringbone gears, but also to form opposed handed helical gears of even very small differences in diameter.

More generally, there is a need for a powder metal tool set that may be used to produce two-part helical gears, whether those two pans are of the same diameter or not.

SUMMARY OF INVENTION

The present invention concerns a multiply-acting powder compacting press and methods for operating that press to produce two pan gears of a variety of types, in particular for producing powder metal symmetrically opposed helical, or herringbone, gears and two pan helical gears whose diameters are substantially the same.

A powder metal multiply-acting press for the purposes of the present invention has a tool set having a core rod, an inner lower, or transfer, punch; an outer lower punch; a lower die; an upper die; and an upper punch. The upper portion (for example Sheet 2 of 2) may comprise an upper outer punch and an upper inner, or pre-lift, punch to aid lateral transfer of powder.

Depending upon the type of gear to be produced the present invention pertains to tool sets in which either two or three elements rotate during the compaction and withdrawal steps of pressing a green powder metal compact.

In a first aspect of the invention there is a tool set for making double helical gear compacts, that tool set comprising a lower punch having a first helical gear profile and a lower die having a mating negative helical profile for helically sliding engagement with the lower punch; an upper, opposed punch having a second helical profile, an upper die having a mating negative helical profile for helically sliding engagement with that upper, opposed punch; that upper punch disposed in opposition to said lower punch; and those lower and upper dies movable to abut at a parting plane.

In a another aspect of the invention the press includes a tool set for making opposed, double helical gear compacts, the tool set comprising a first punch having a Dust helical gear profile; a Dust die having a negative helical profile for mating with the Dust punch; a second, opposed punch having a second, opposite handed, helical profile; a second die having a negative helical profile for mating with the second, opposed punch. The tool set is movable to a filling position for receiving a charge of powder metal; a transfer position; a compaction position; and a withdrawal position; a) in the transfer position the dies are disposed in longitudinally abutting, unrotated relationship; the punches are in a first, retracted, opposed, spaced apart relationship; whereby a cavity for containing the powder metal charge is defined longitudinally by the opposed faces of the punches and peripherally by the dies; b) in a compaction position the punches are in a second, advanced, opposed, spaced apart relationship; the dies remain in abutting relationship; and the dies are moved to a partially rotated position whereby the cavity is reduced in size to compact the powder; c) in a withdrawal position the punches remain in an advanced, opposed, spaced apart relationship; and the dies are disposed in a fully rotated position whereby moving the dies to a fully rotated position causes the dies to separate and expose a compressed workpiece. Furthermore, the tool set may comprise a transfer punch surrounded by the first punch; and in the transfer position such transfer punch being in an advanced position to urge the powder charge to spread throughout the cavity.

The invention may further involve a pitch drive for coordinating rotation of the dies during longitudinal translation of the punches, the pitch drive receiving mechanical input from the motion of at least one of die punches and providing output to at least one of the dies; and that pitch drive may be a cam and roller mechanism, one of a) a cam or b) a roller in rigid structural relationship to one of the punches whether upper or lower; the other of a) the roller or b) the cam in rigid structural relationship with the corresponding upper or lower die, whereby longitudinal translation of that one of the punches relative to that one of the dies compels rolling engagement of the roller and the cam and consequential relative rotation of that die with respect to that punch.

A third aspect of the invention involves a method for using a tool set to make powder metal opposed helical gear compacts, that tool set having a First punch having a first helical gear profile; a first die: having a mating helical profile for mating with the first punch; a second, opposed punch having a second, opposite handed helical profile; a second die having a helical profile for mating with the second, opposed punch; and a transfer punch, the method comprising moving the tool set to a filling position; introducing a charge of powder metal to the tool set; moving the tool set to a transfer position in which the dies are in longitudinal abutting relationship and the punches are in a retracted, spaced apart relationship, a cavity being formed within the dies between the opposed punches; moving the transfer punch relative to the cavity to distribute the charge throughout the cavity; compacting the powder in the cavity to form a workpiece; withdrawing the dies to expose the workpiece; and removing the workpiece. The step of compacting the powder may be achieved by maintaining the first punch in one position. advancing the second punch toward the first punch; translating the dies longitudinally in the same direction as the second punch while simultaneously rotating the dies, the step of moving the transfer punch may be achieved by holding the transfer punch stationary and advancing the other punches and the dies in unison.

In a fourth aspect there is a method for making asymmetric double helical gear compacts in a multiply acting press, that method comprising the steps of a) filling a cavity lower portion with a charge of powder; displacing the upper and lower dies to abut at a parting plane with opposing distal end faces of upper and lower punches proportionately distant from a parting plane; c) displacing a transfer punch to distribute the charge of powder throughout the cavity; d) compacting the charge of powder to form a powder compact by advancing upper, lower, and transfer punches proportionately toward the parting plane while the upper punch rotates relative to the upper die and the lower punch rotates relative to the lower die; e) withdrawing both of i) the upper die along said upper punch, and ii) the lower die along the lower punch, during relative rotation of the dies relative to the punches and the powder compact, to a first withdrawal position in which one of the dies clears the powder compact; withdrawing the other of the dies along its mating punch, to a second withdrawal position in which the other die clears the powder compact; and g) ejecting that powder compact.

In a fifth aspect of the invention one finds gears that can be produced with the tool sets described. Those gears include double helical, sintered powder metal gears that differ in pitch diameter only by a small amount, such as twice the sum of the dedendum of the larger gear, the addendum of the smaller gear and 2 millimeters. That aspect of the invention includes gears of substantially equal: diameter, and, in particular. herringbone gears.

Figure 1:
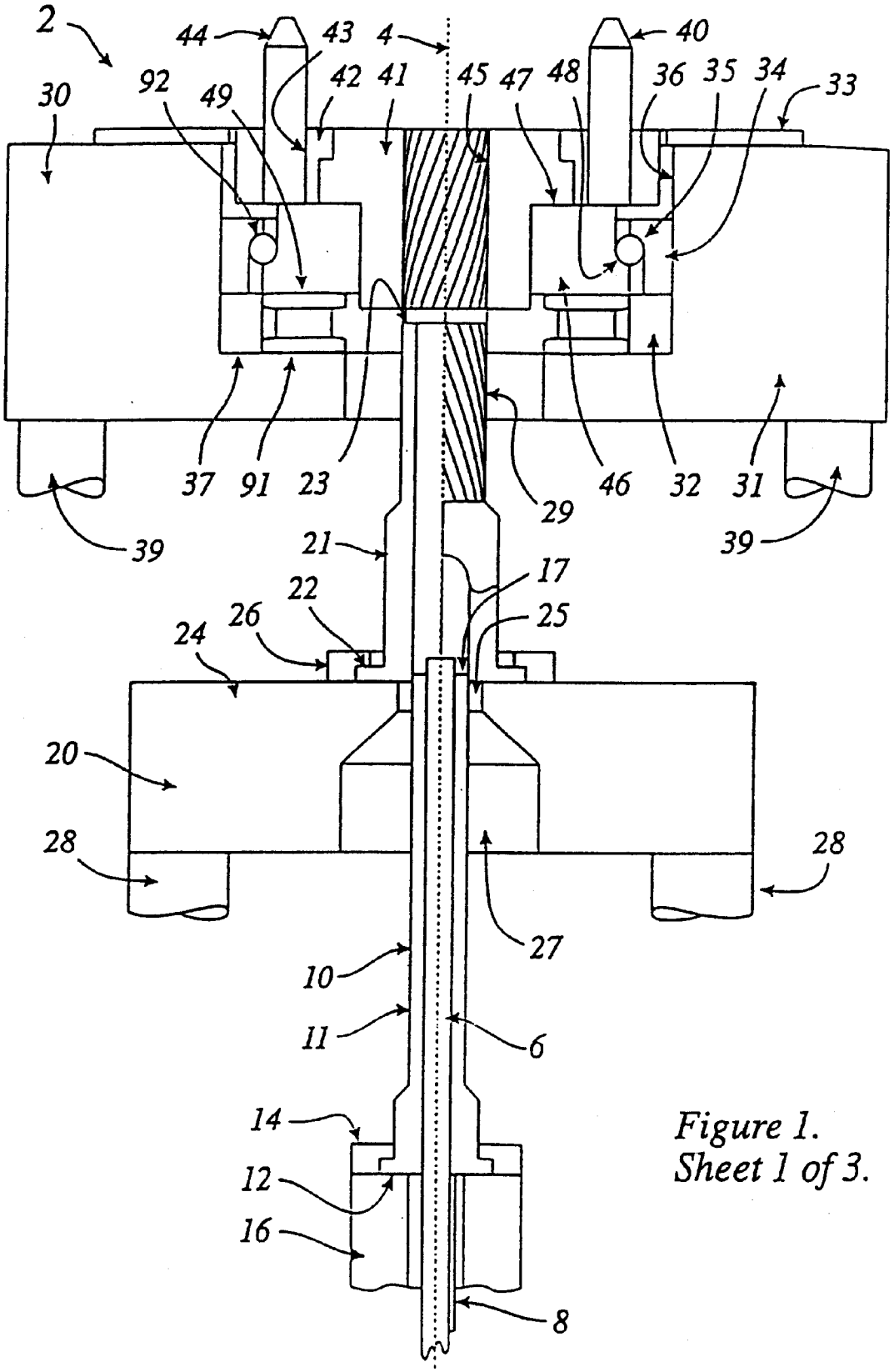
FIG. 1 is an exploded view of two embodiments of the powder metal press of the present invention.
Figure 1:
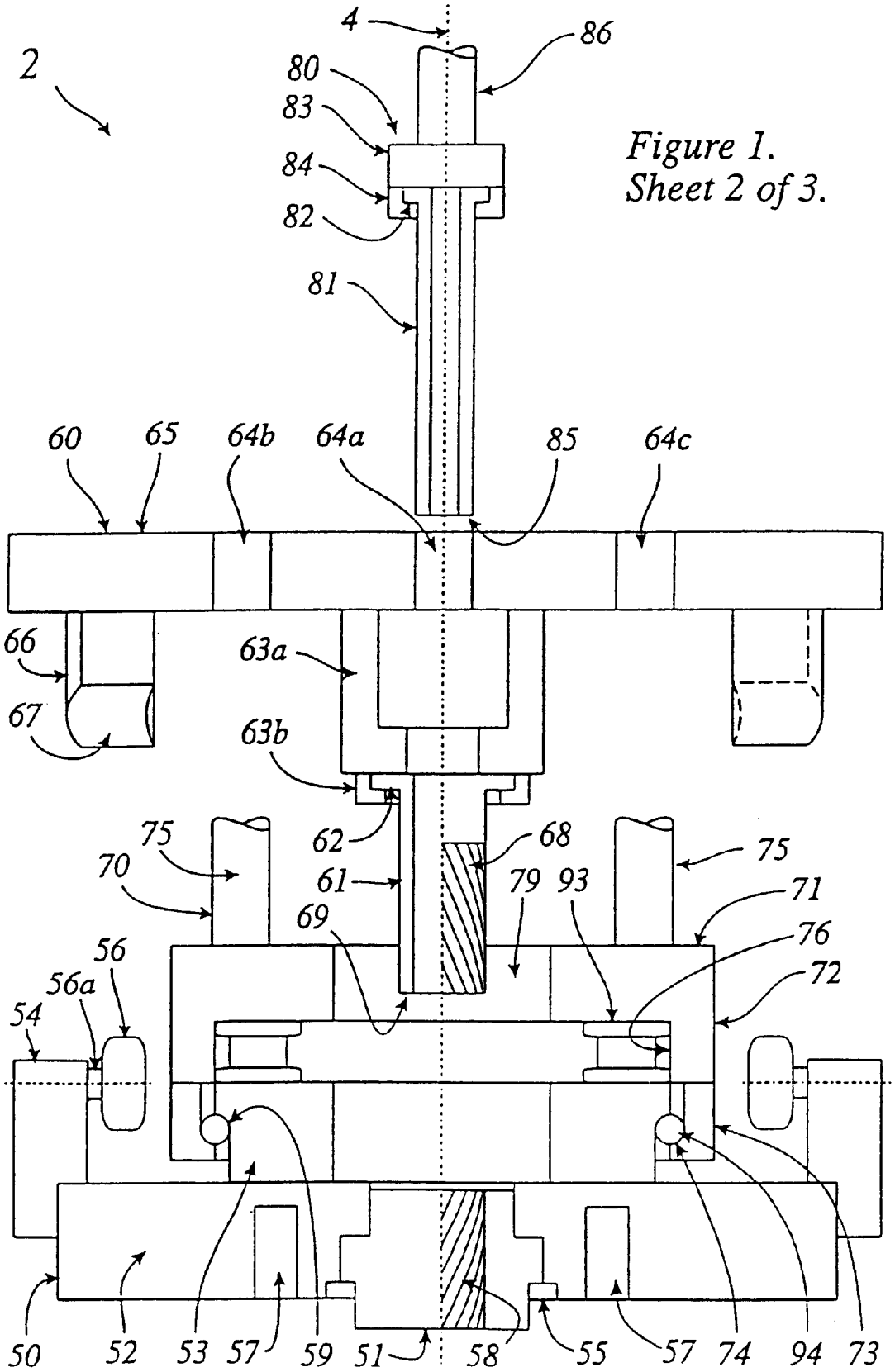
Figure 1:
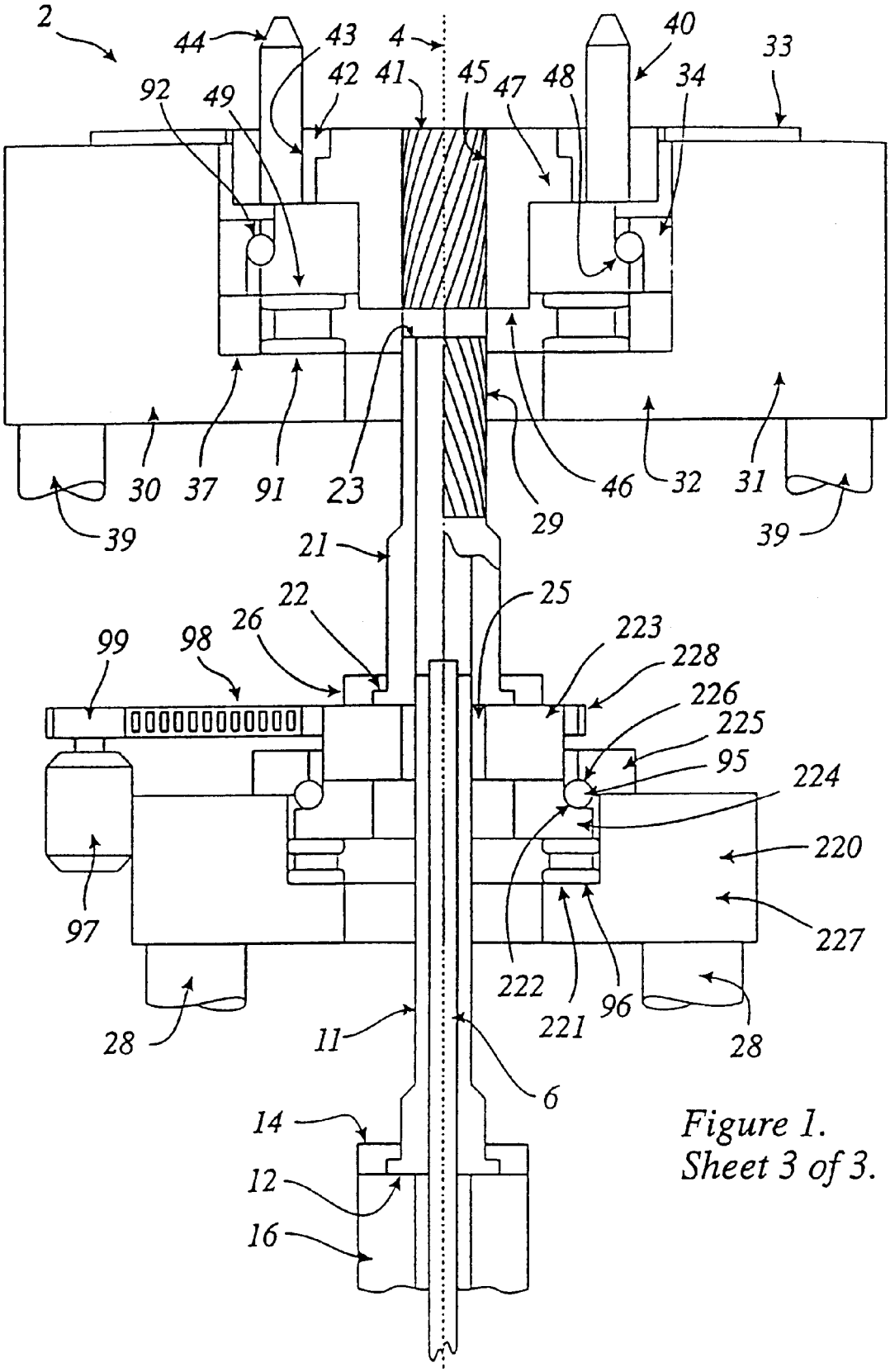

Sheet 1 of 3 of FIG. 1 illustrates the lower portions of a tool set of the present invention including a core rod, lower inner punch assembly, lower outer punch assembly and rotating lower die assembly.

Sheet 2 of 3 of FIG. 1 illustrates a corresponding upper portion of the tool set of the present invention including a rotating upper die assembly, upper outer punch assembly, and inner punch assembly.

Sheet 3 of 3 of FIG. 1 illustrates an alternate embodiment of the lower portions of the tool set of the present invention, differing from Sheet 1 in having a rotating lower outer punch assembly.

Figure 2:
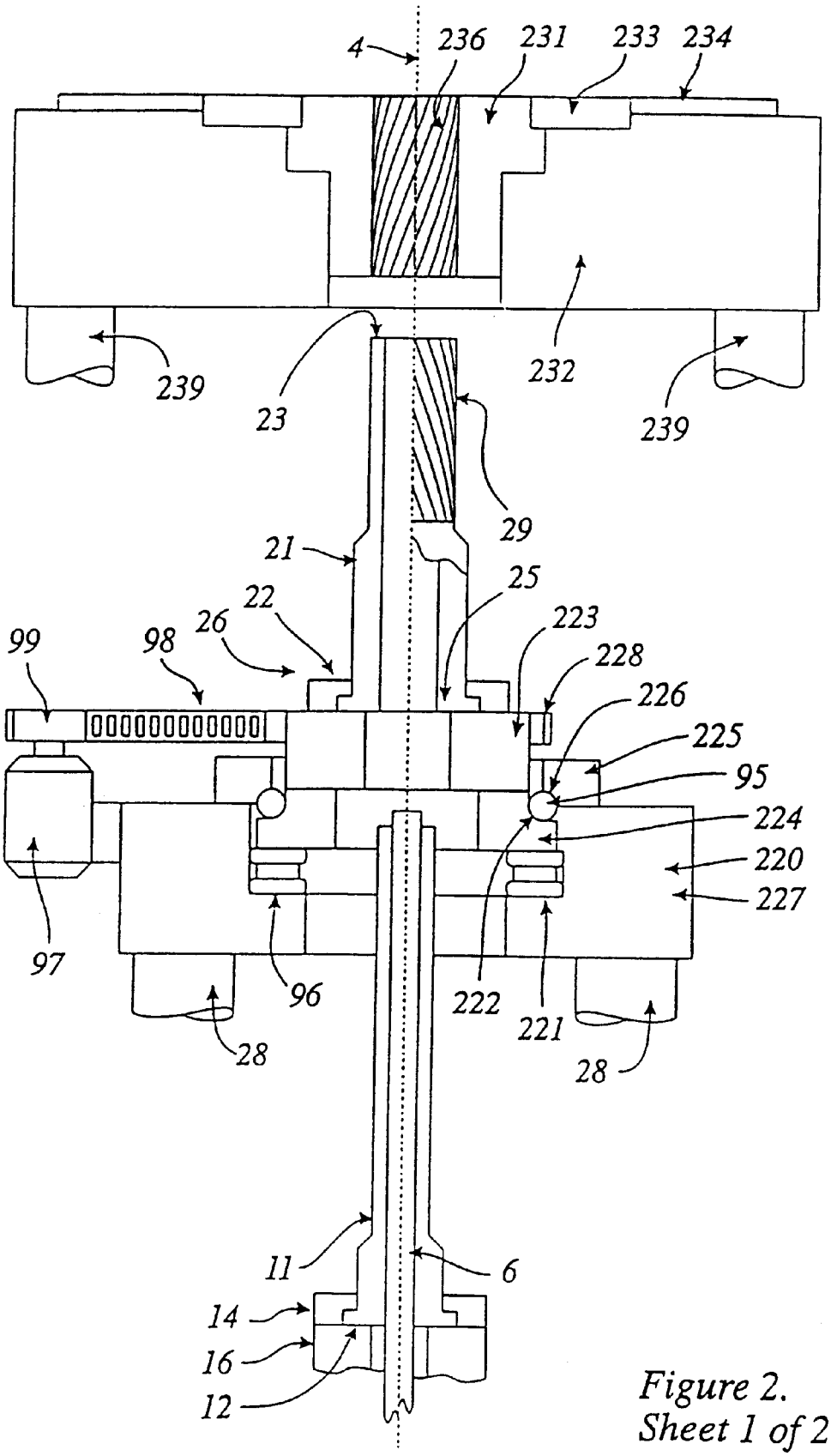
Figure 2:
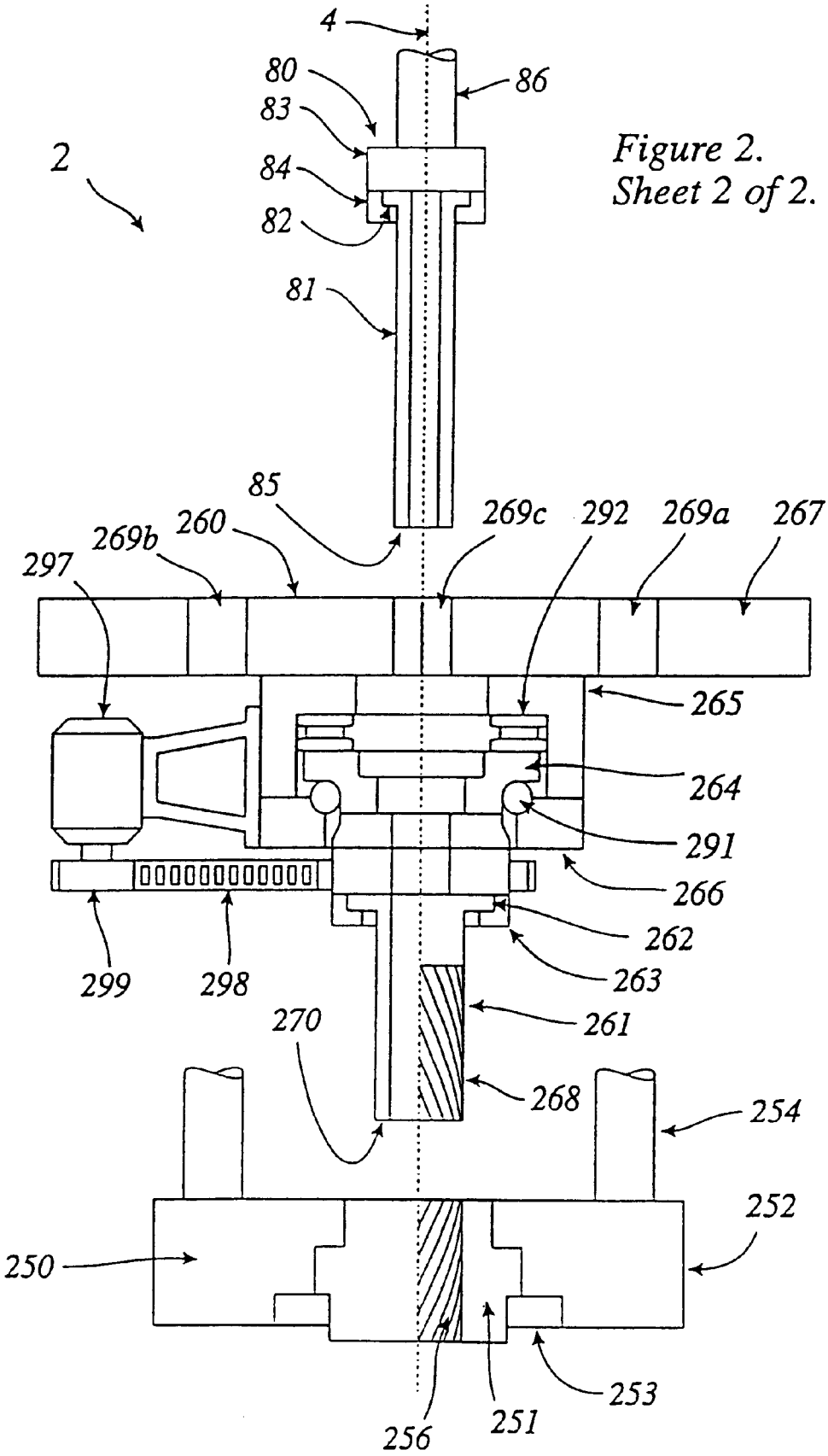

FIG. 2 is an exploded view of a third embodiment of the powder metal press of the invention of FIG. 1.

Sheet 1 of 2 illustrates the lower portions of a tool set of the invention of FIG. 1 differing therefrom by a rotating lower outer punch assembly and a non-rotating lower die assembly.

Sheet 2 of 2 of FIG. 2 illustrates the upper portions of a tool set of the invention of FIG. 1 differing therefrom by a rotating upper outer punch assembly and a non-rotating upper die assembly.

Figures 3A, 3B:
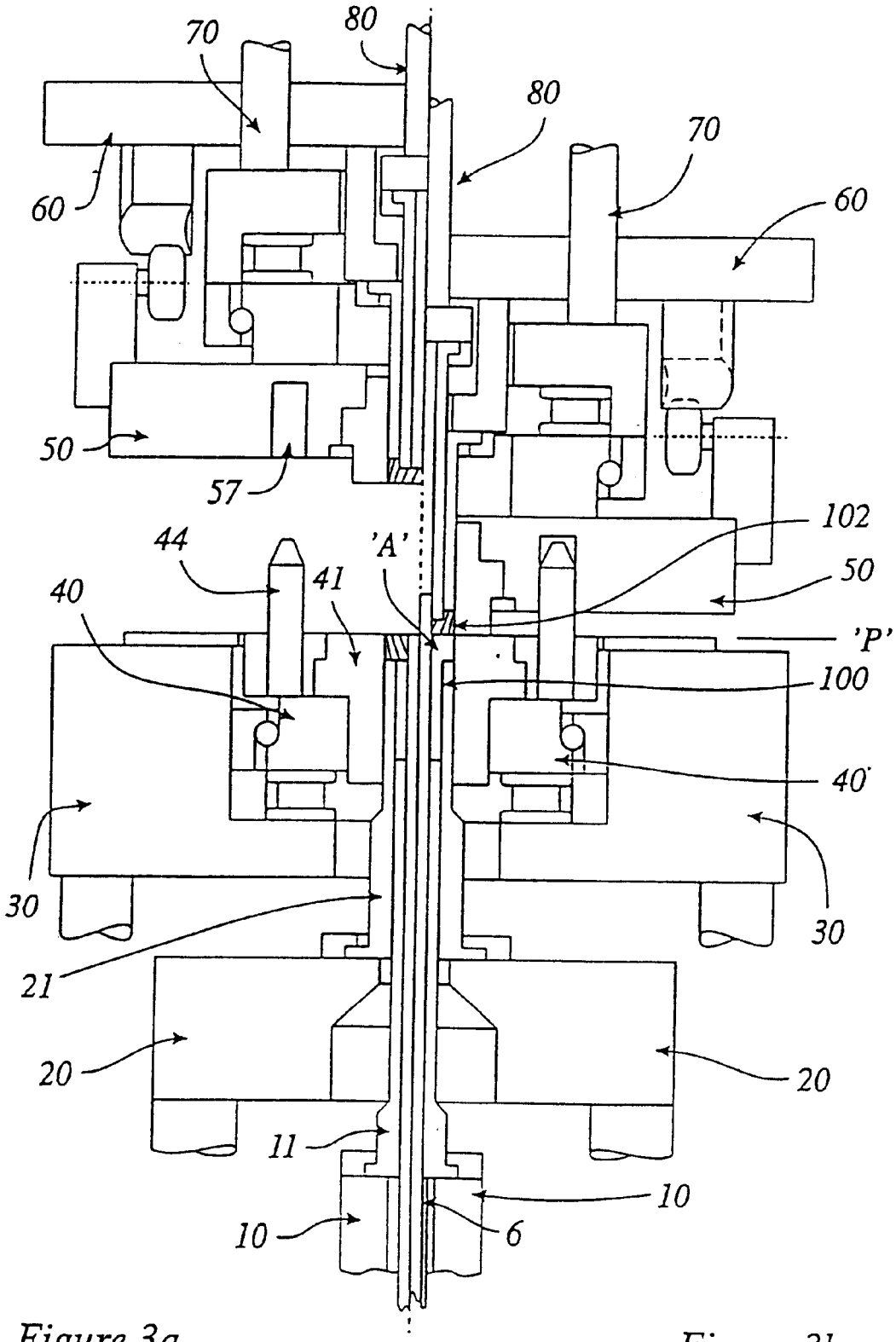
Figures 3C, 3D:
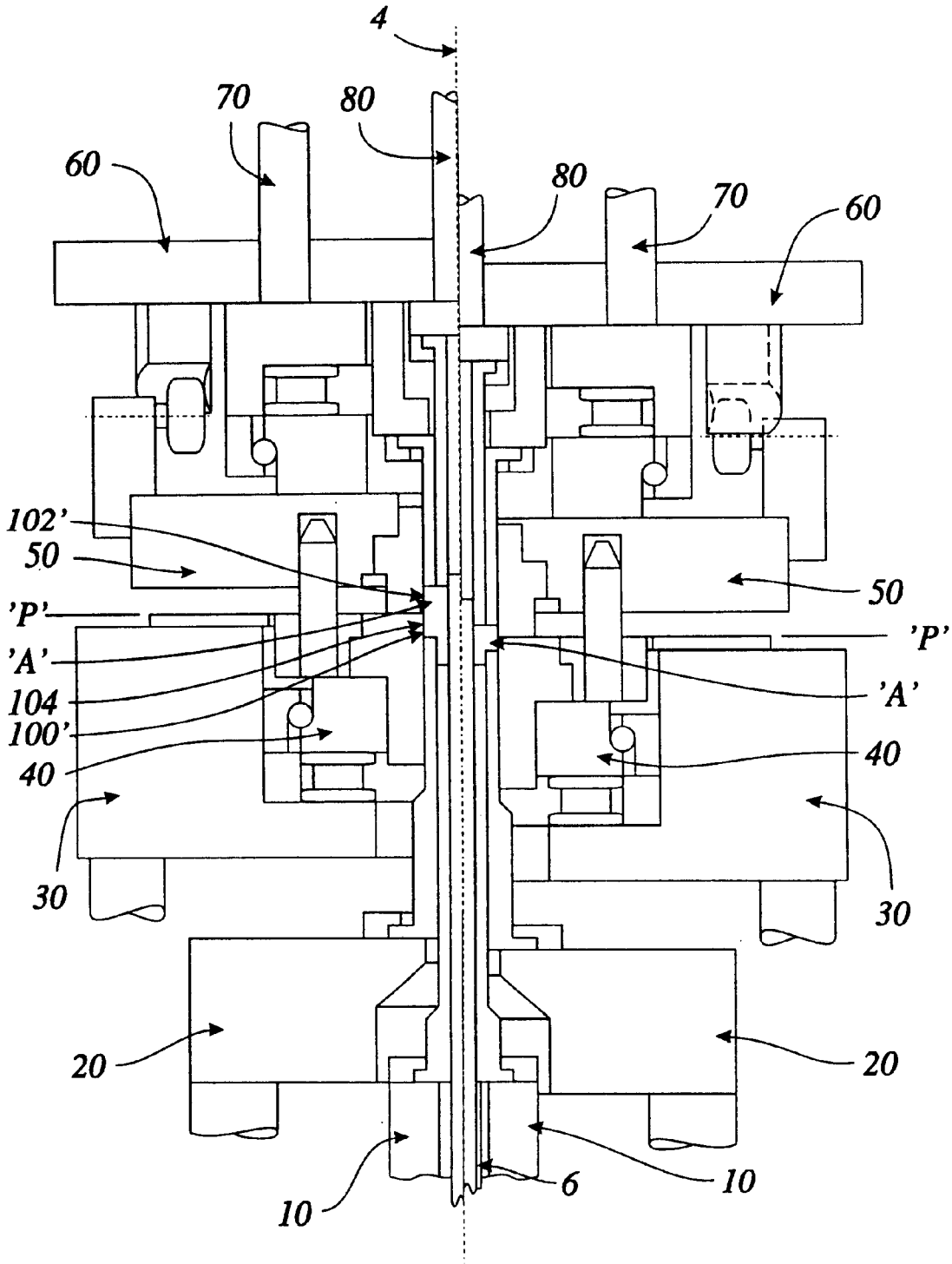
Figures 3E, 3F:
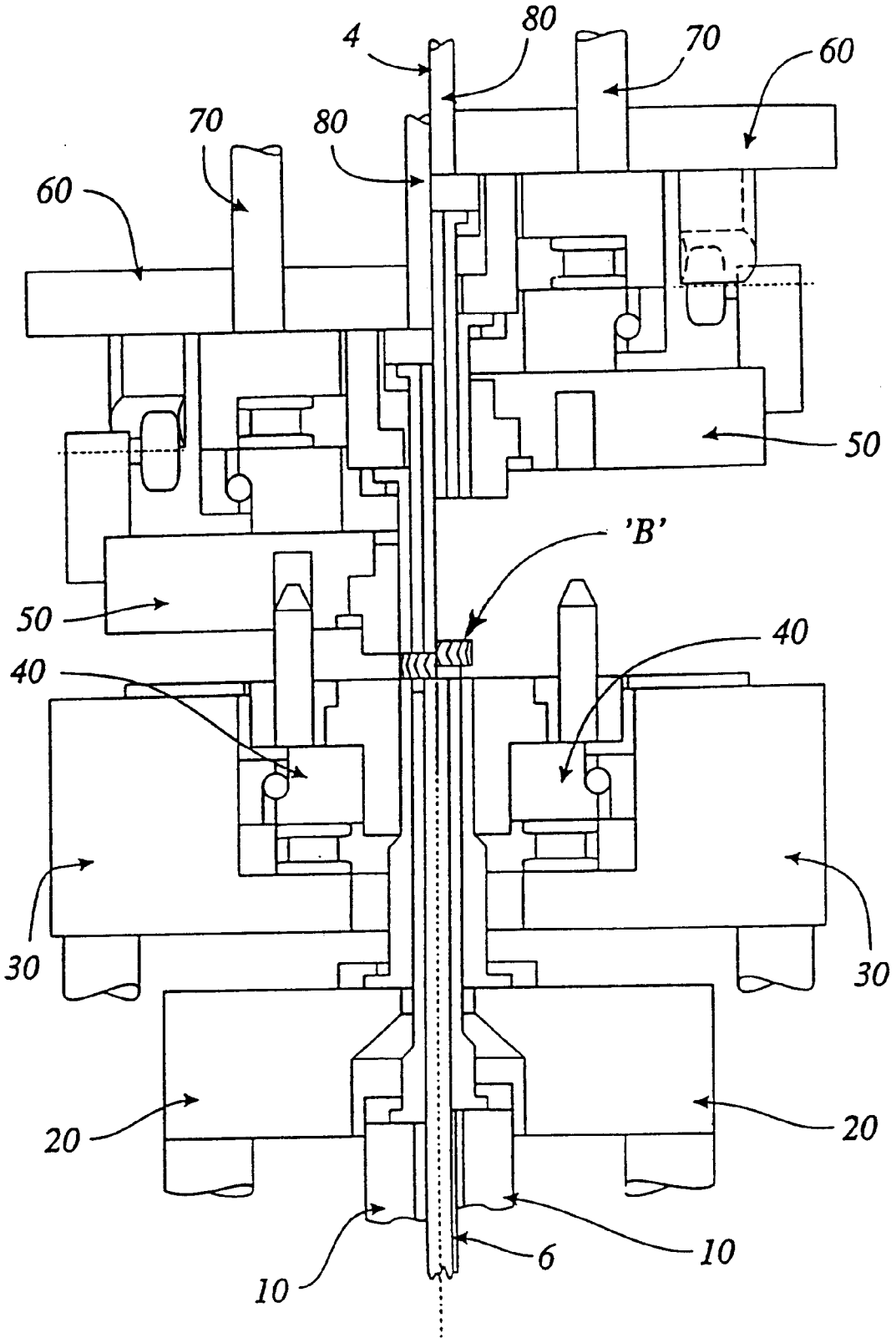

FIG. 3 shows a sequence of views, being FIGS. 3*a* through 3*f* which illustrate a progression of steps by which the invention as illustrated in sheets 1 and 2 of 3 of FIG. 1 is used to compress powder metal to form a powder metal powder compact FIG. 3*a* shows a cross-section of a tool set in the filling position.

FIG. 3*b* shows the same tool set with upper and lower portions brought together prior to the transfer step.

FIG. 3*c* shows the tool set after transfer and before compaction.

FIG. 3*d* shows the tool set after compaction and before withdrawal.

FIG. 3*e* shows the tool set after withdrawal and before ejection.

FIG. 3*f* shows the tool set in the ejection position.

Figures 4A, 4B:
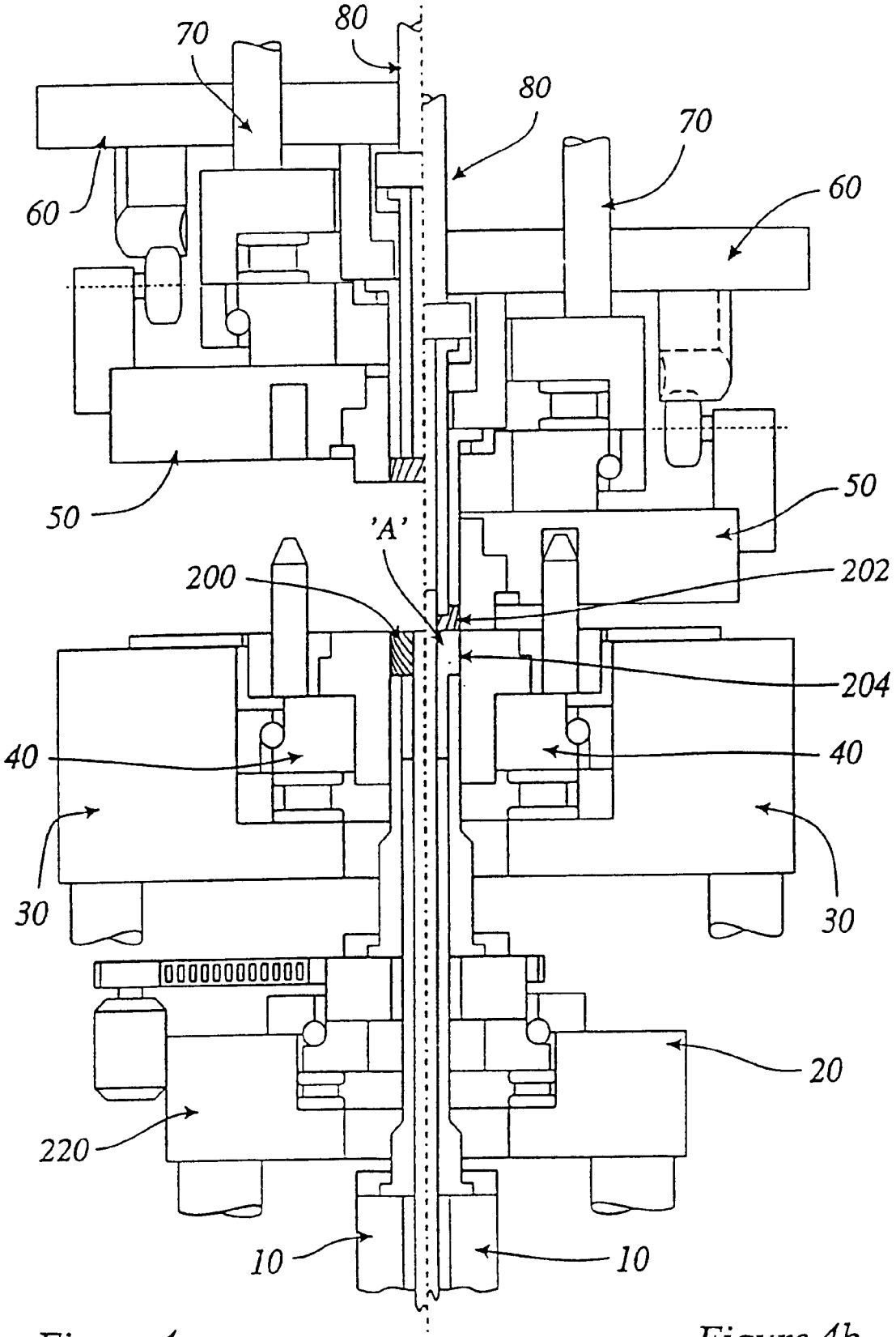
Figures 4C, 4D:
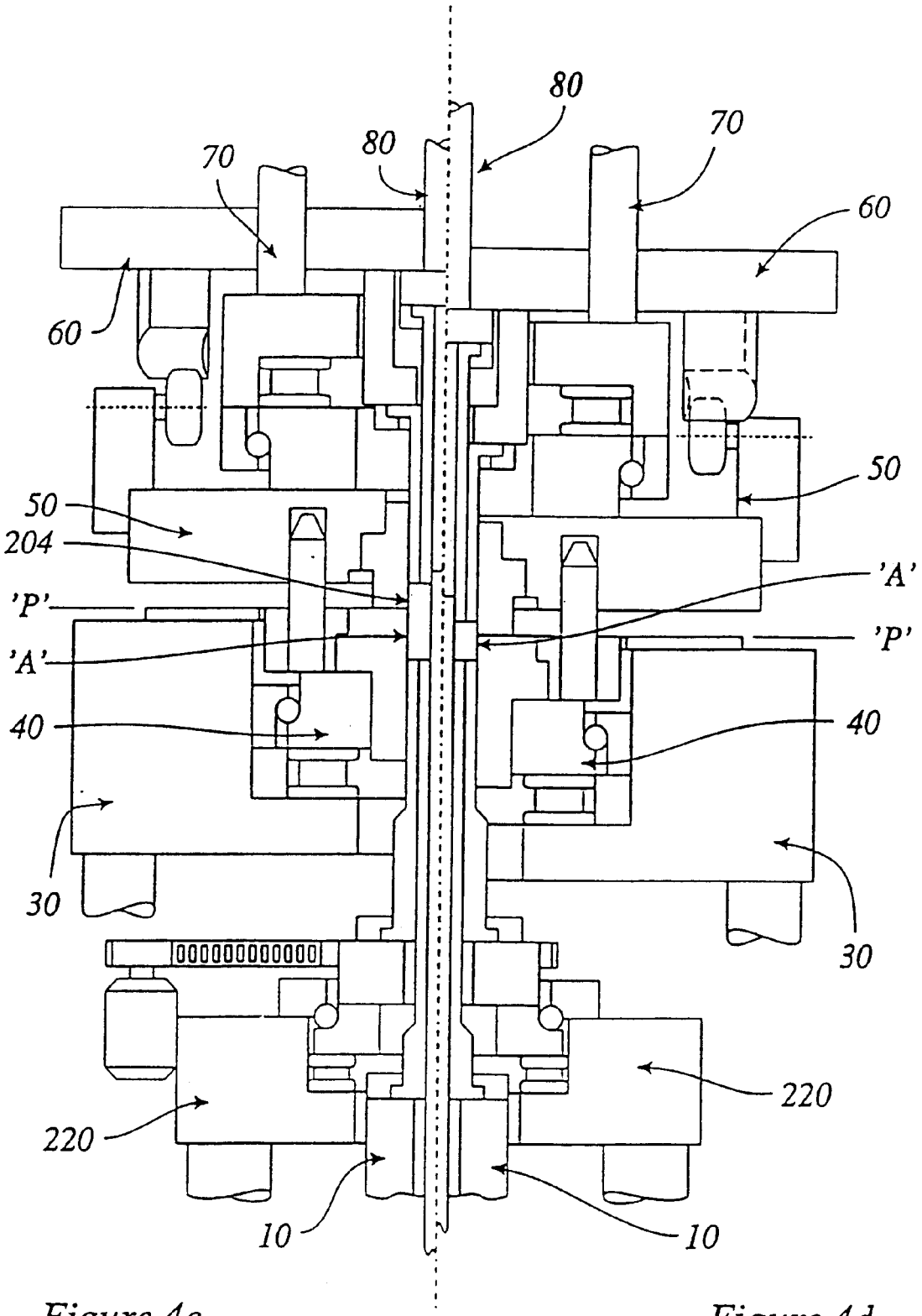
Figures 4E, 4F:
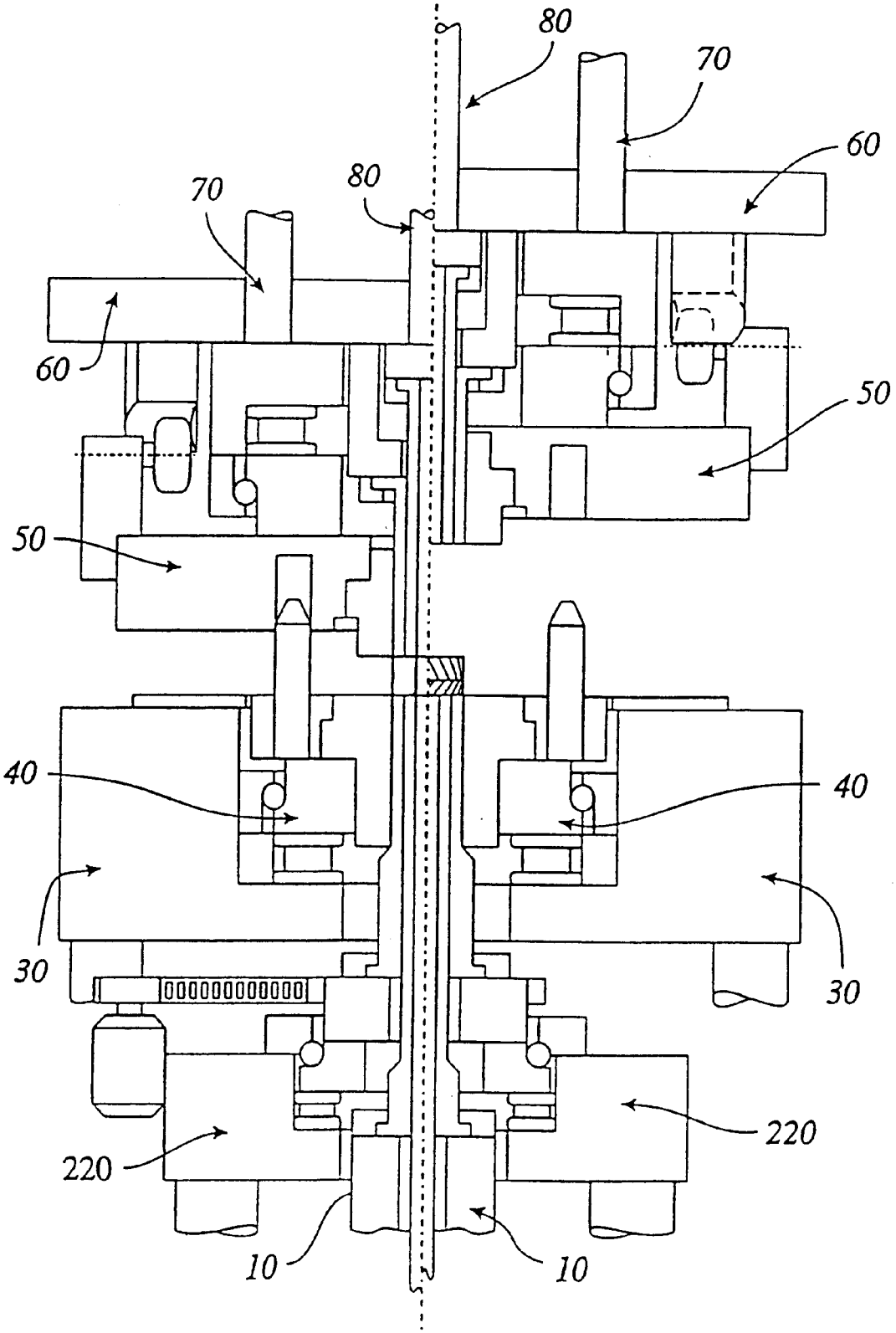

FIG. 4 shows a sequence of views, being FIGS. 4*a* through 4*f* which illustrates the progression of steps by which the invention as illustrated in sheets 2 and 3 of 3 of FIG. 1 is used to form a green powder metal compact, FIGS. 4*a,* 4*b,* 4*c,* 4*d* and 4*f* corresponding to FIGS. 3*a,* 3*b,* 3*c,* 3*d* and 3*f* and FIG. 4*e* illustrating a tool set after top ram retraction (ejection).

Figures 5A, 5B:
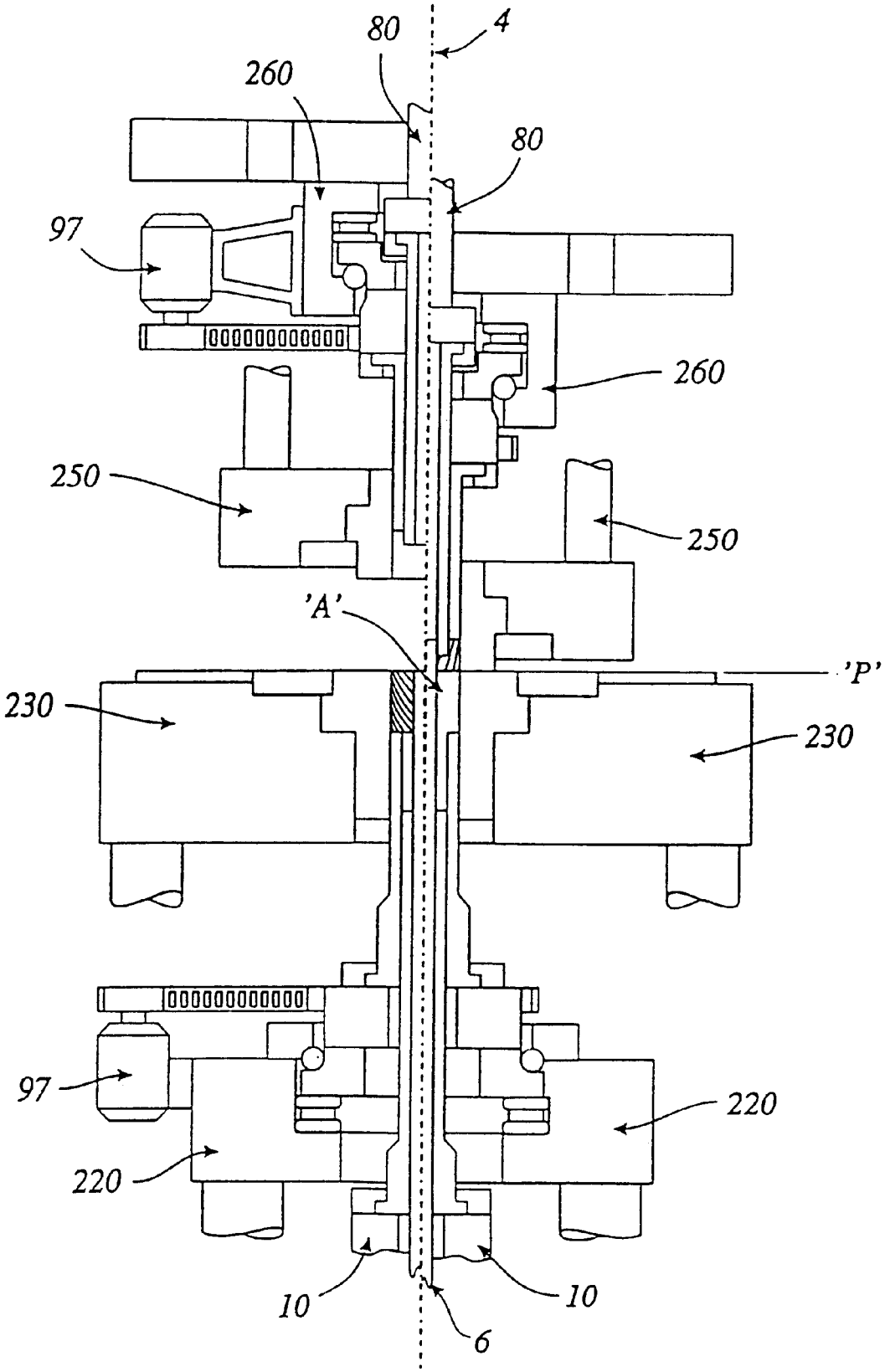
Figures 5C, 5D:
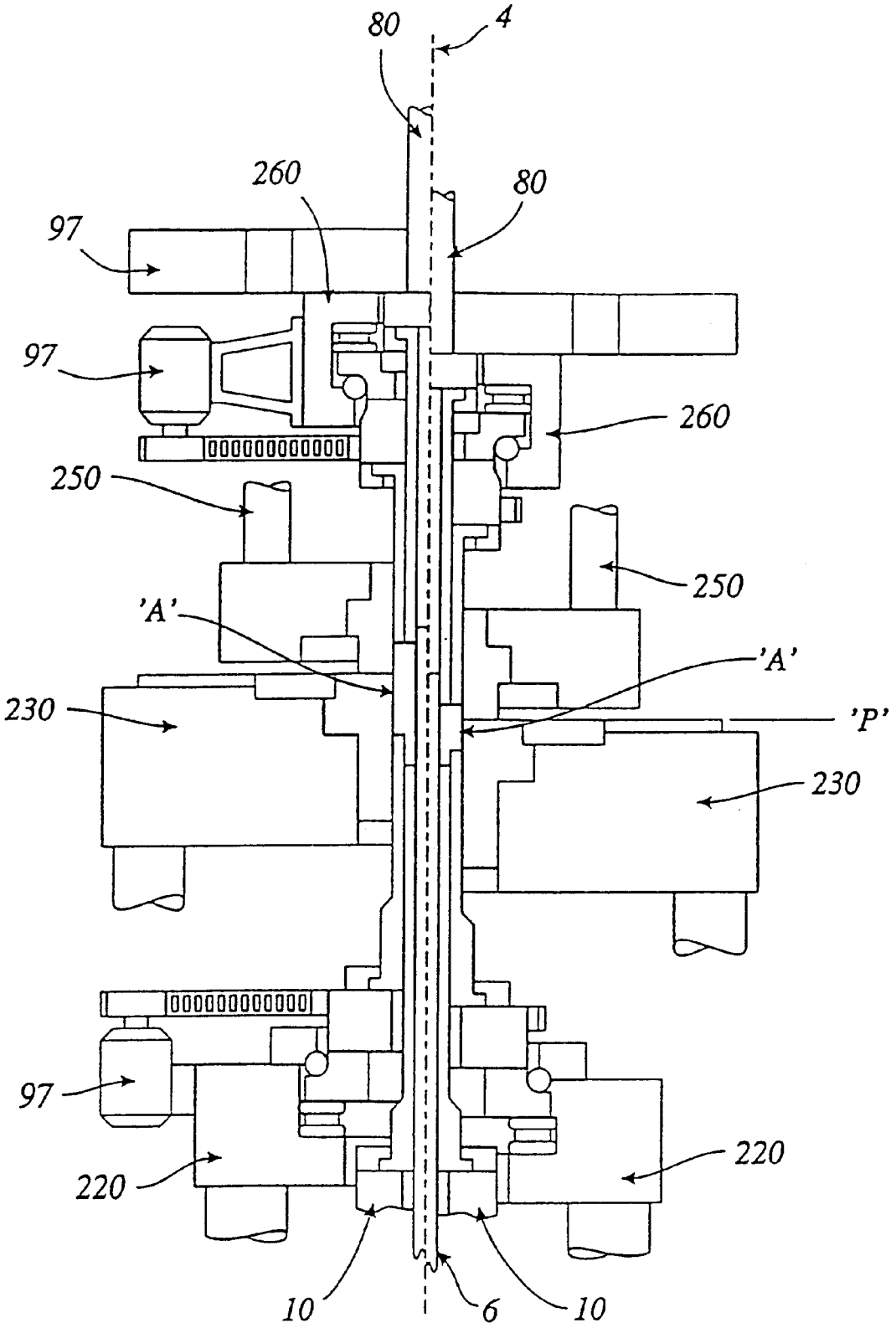
Figures 5E, 5F:
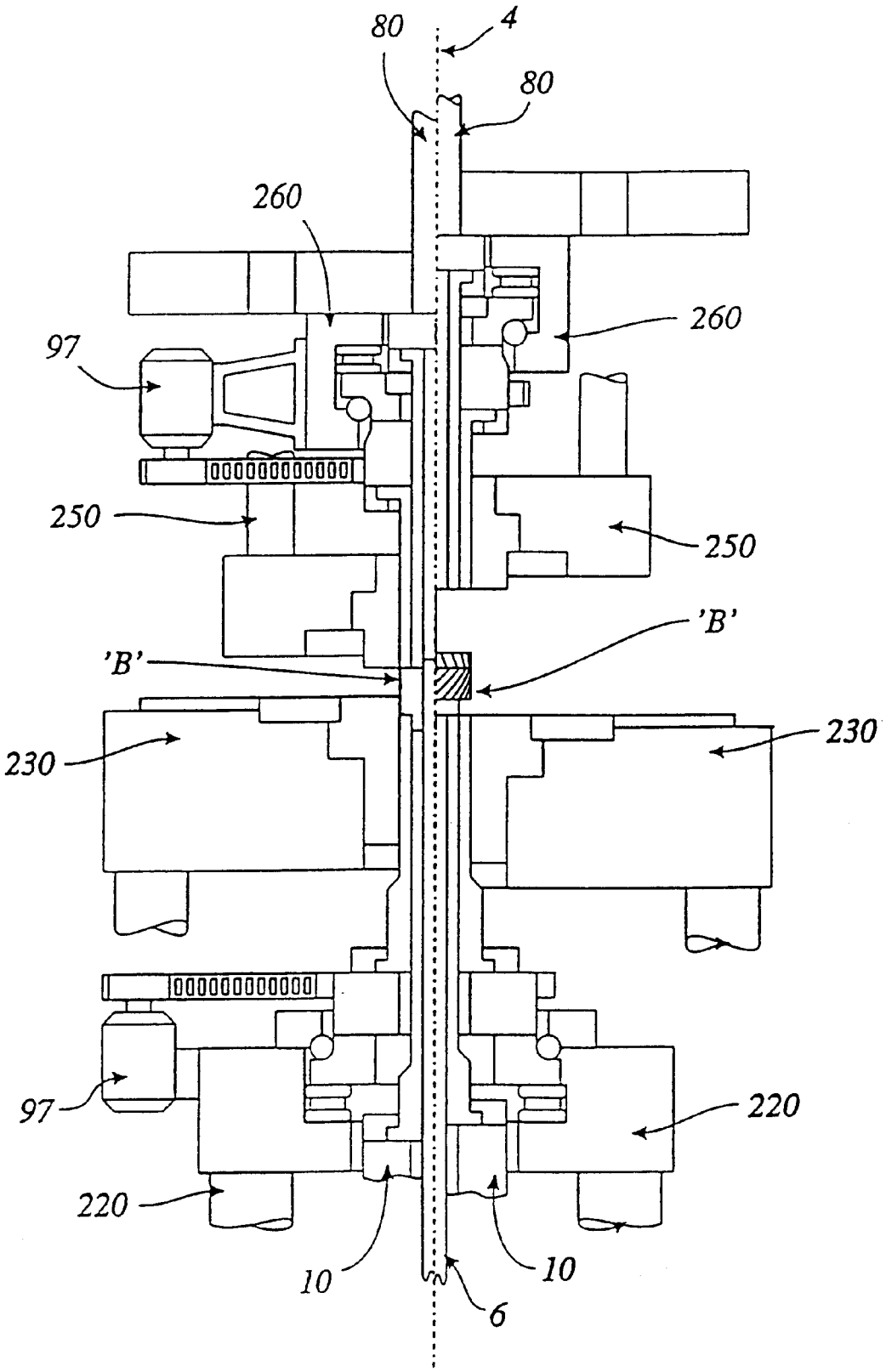

FIG. 5 shows a sequence of views, being FIGS. 5*a* through 5*f,* corresponding generally to FIGS. 3*a* through 3*f,* for the embodiment present invention shown in FIG. 2, FIG. 5*e* showing a partial withdrawal position, and FIG. 5*f* showing a full withdrawal and ejection position.

Figure 6:
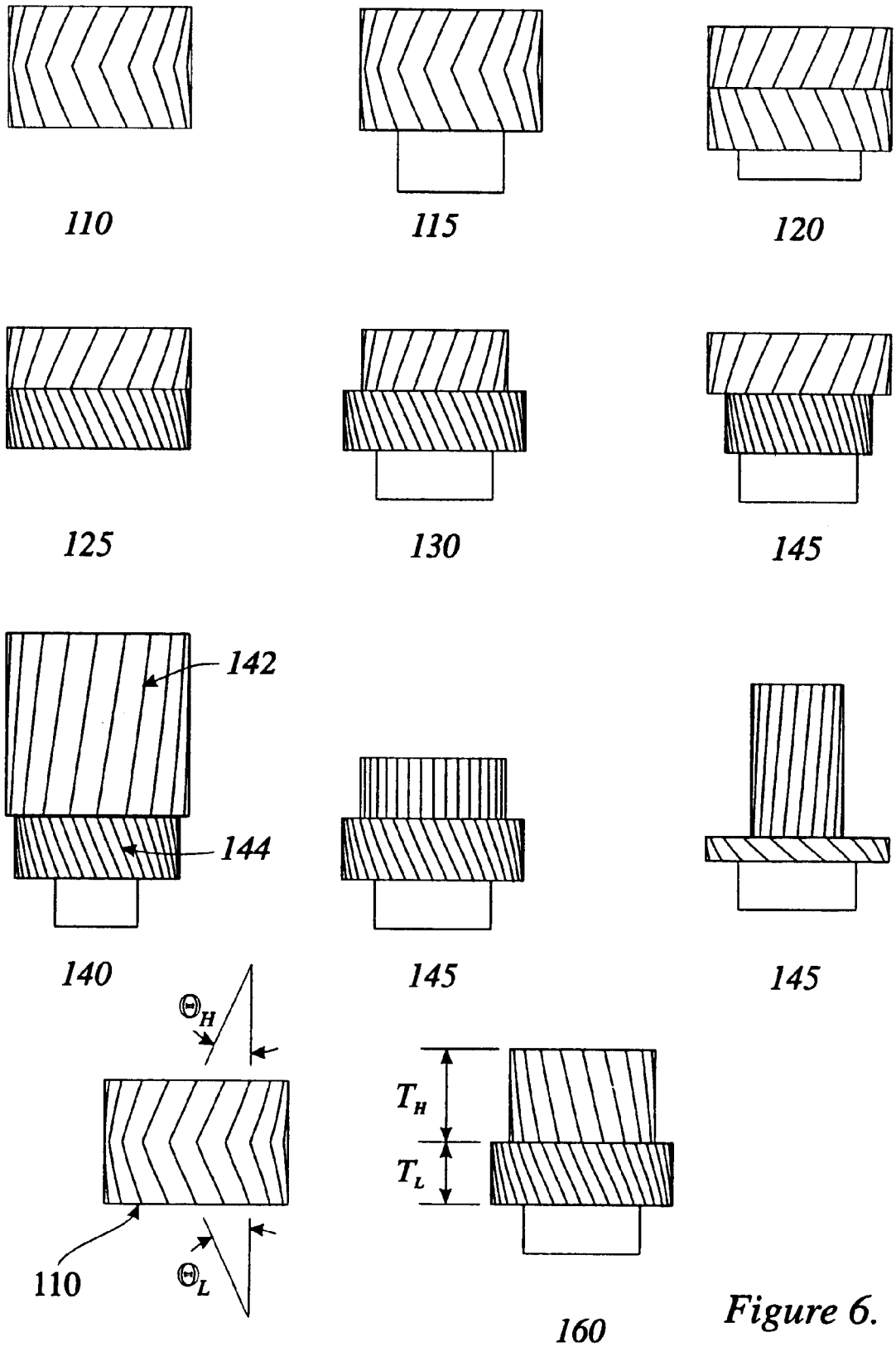

FIG. 6 shows a variety of gears which may be produced with one or more of the embodiments of the invention of FIG. 1.

Figure 7:
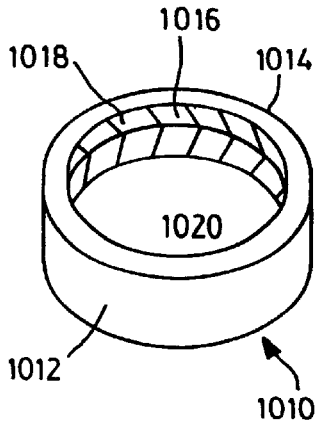

FIG. 7 is a perspective view of a component formed from metallic powder.

Figure 8:
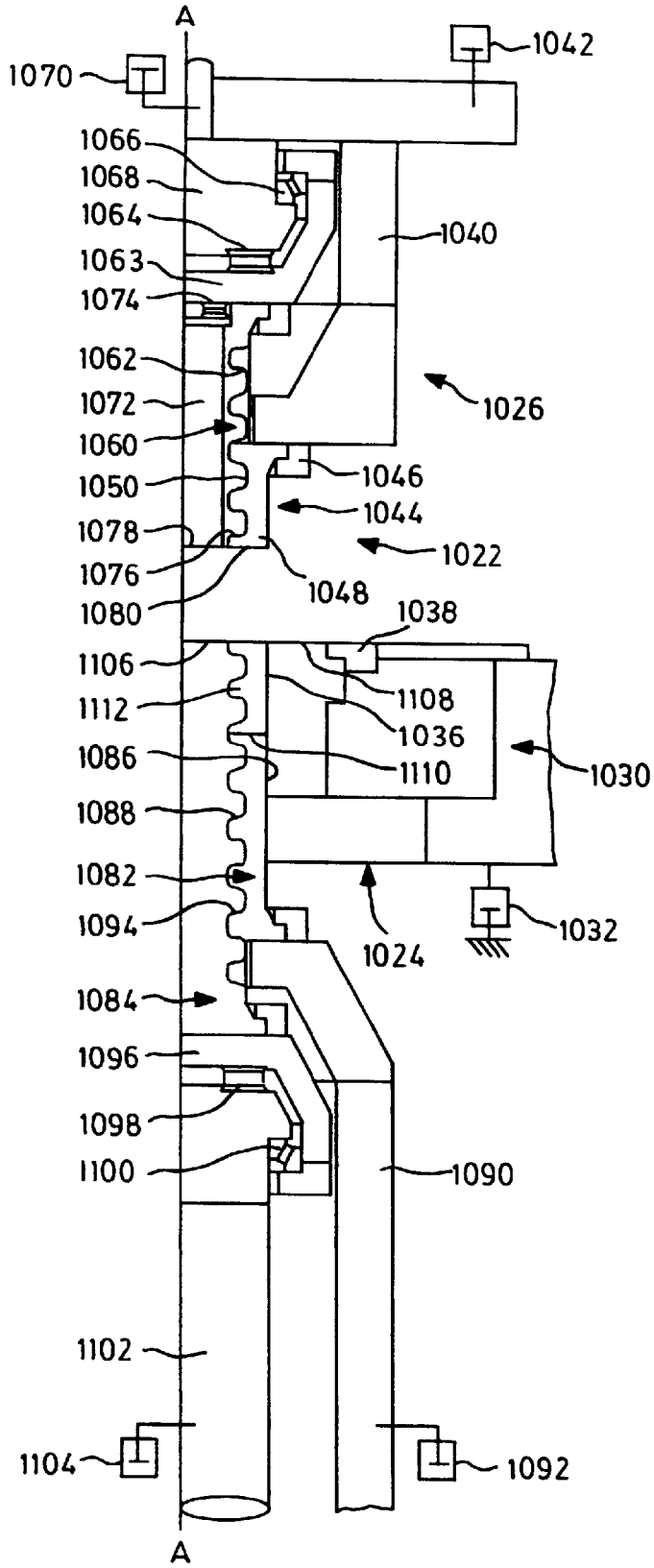

FIG. 8 is a section through a tool set and associated press components showing the tool set in is an open position.

Figures 9, 10:
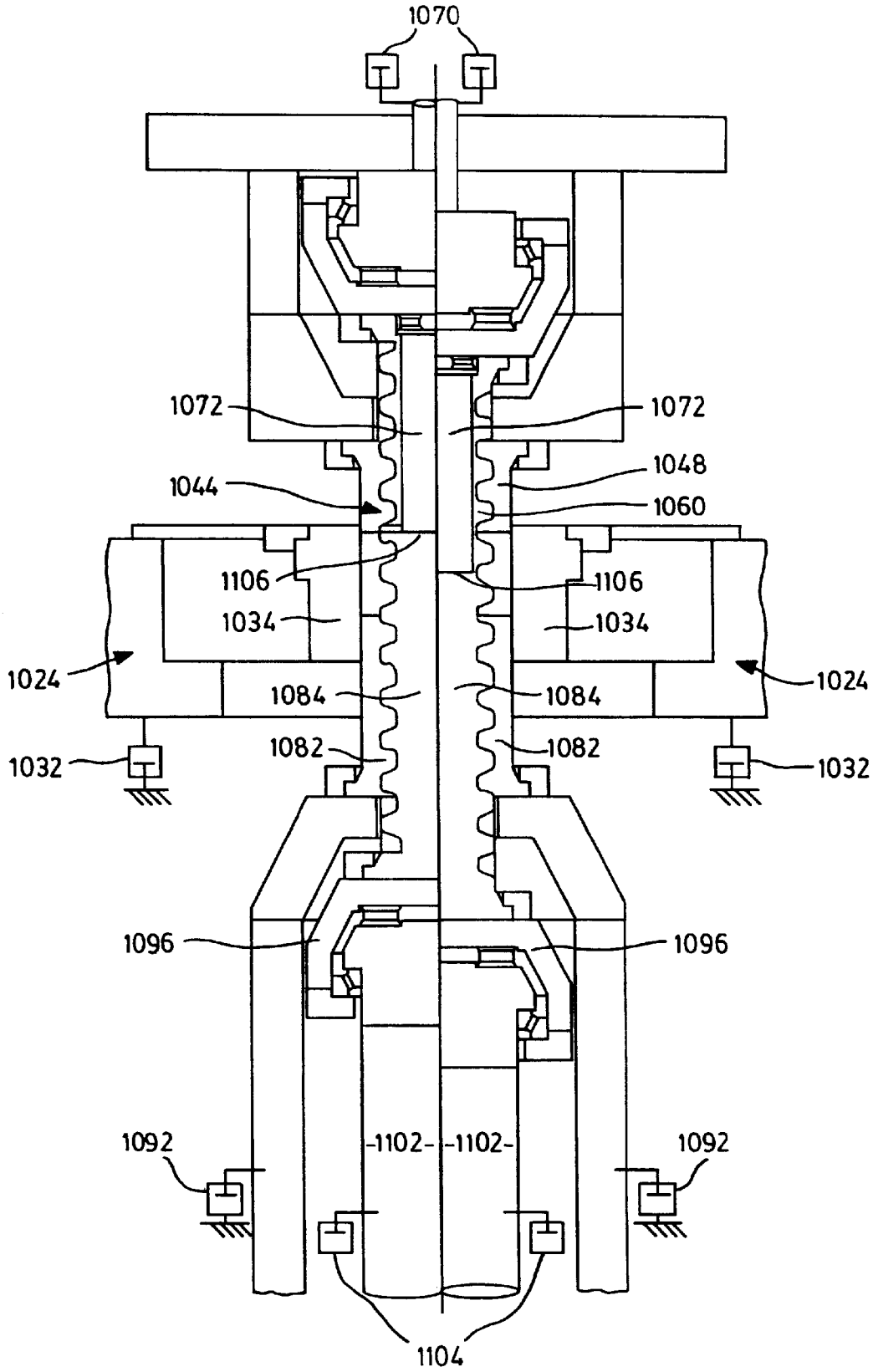

FIG. 9 is a section similar to FIG. 8 with the tool set in an initial closed position.

FIG. 10 is a view similar to FIG. 8 with the tool set in a pre compression configuration.

Figures 11, 12:
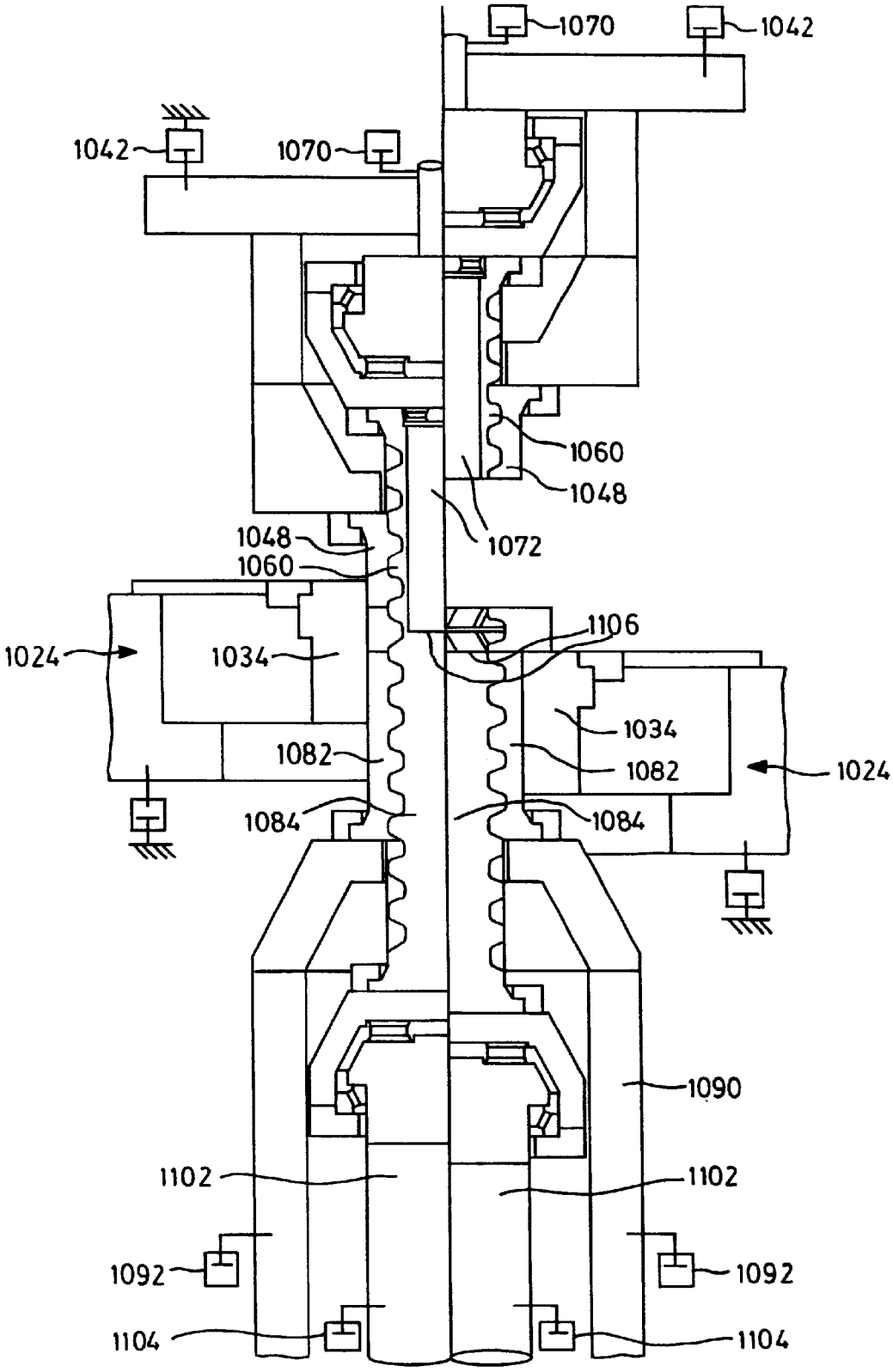

FIG. 11 is a view similar to FIG. 8 with the die set in a compressed position .

FIG. 12 is a view similar to FIG. 8 with the die set in an eject position.

Figure 13:
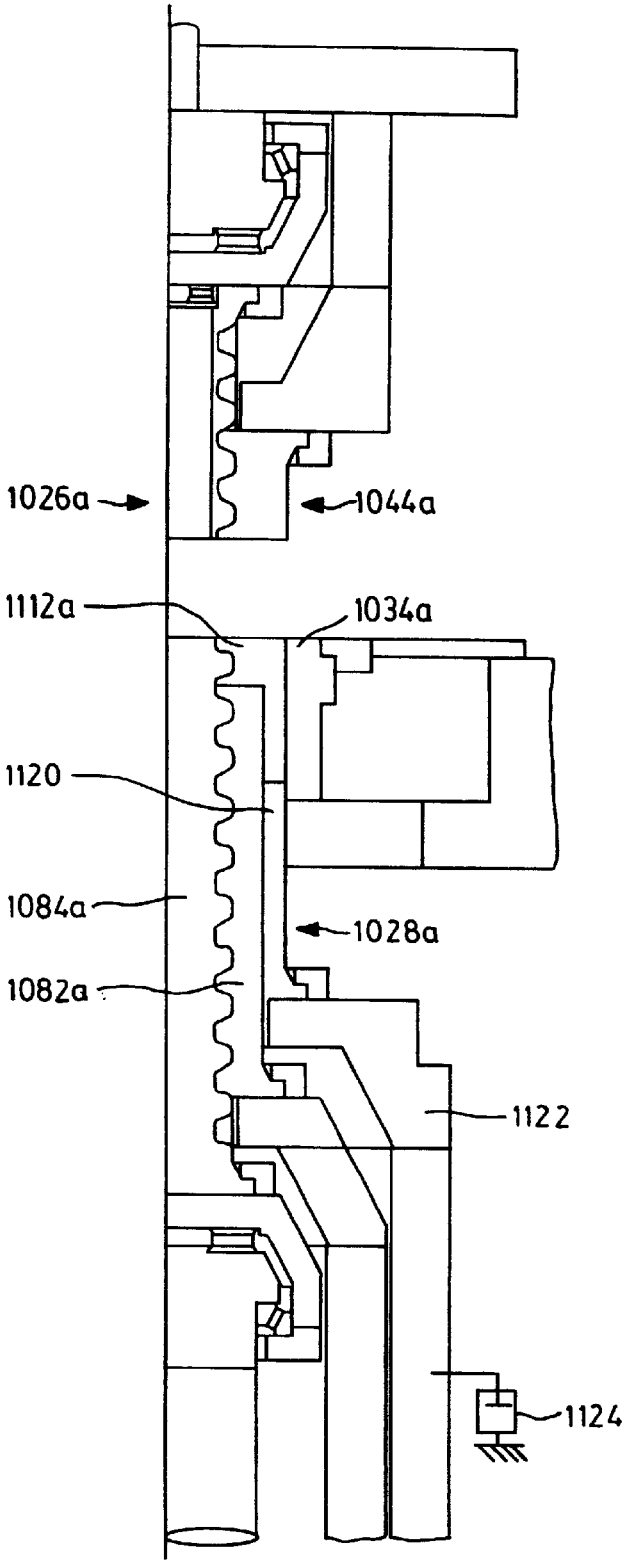

FIG. 13 is a view similar to FIG. 8 of an alternative embodiment of tool set.

Figures 14, 15:
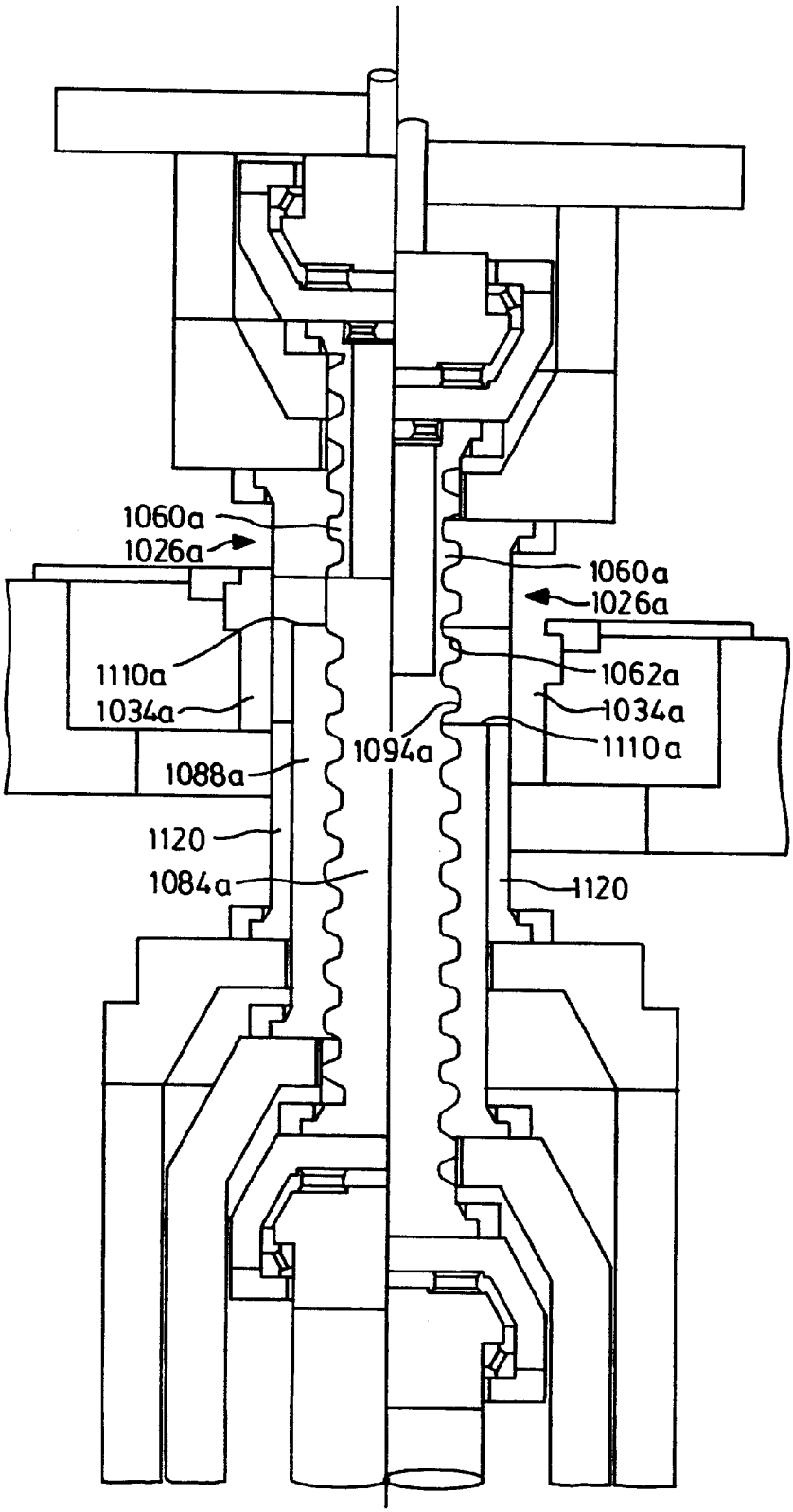

FIG. 14 is a view similar to FIG. 9 of the alternative configuration.

FIG. 15 is a view similar to FIG. 10 of the alternative configuration.

Figures 16, 17:
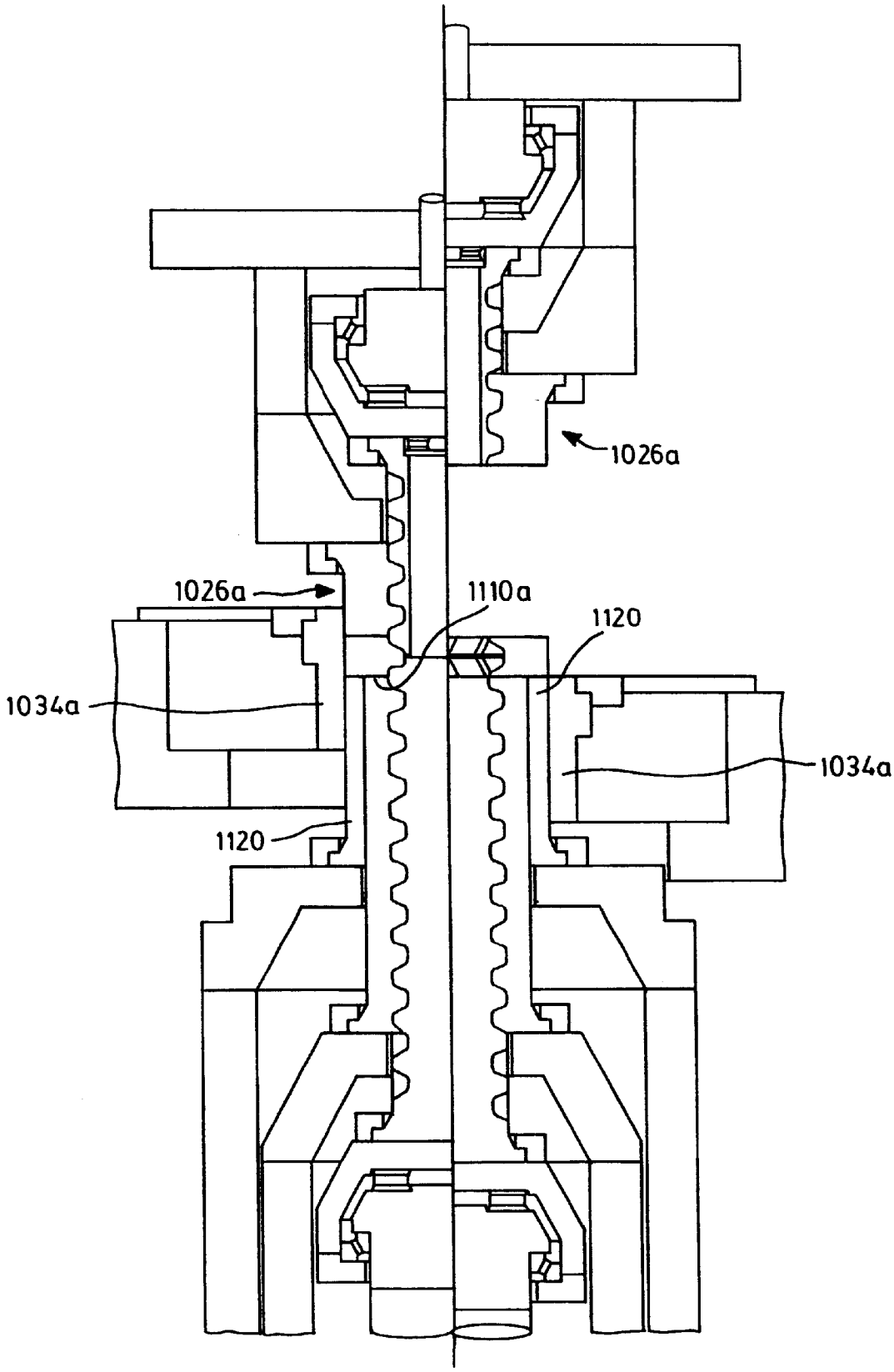

FIG. 16 is a view similar to FIG. 11 of the alternative configuration.

FIG. 17 is a view similar to FIG. 12 with the alternative configuration tool set in an eject position.

NOTE: FIGS. 1 through 5 and 8 to 17 are all cross sectional views in which, cross hatching has been omitted for clarity.

DETAILED DESCRIPTION OF THE BEST MODE FOR CARRYING OUT THE INVENTION

A preferred embodiment of the tool set of the multiply acting powder compacting press of the present invention is shown on Sheet 1 of 3 of FIG. 1 as 2, and has a central vertical axis 4. It comprises a number of assemblies which if described as distinct groups may facilitate understanding of the description of operation of the press hereinbelow. A core rod is shown as 6. Grouped assemblies are indicated as an inner lower transfer punch assembly 10, an outer lower punch assembly 20, a lower die support assembly 30, a lower die carrier 40, an upper die carrier SO, an upper, outer punch assembly 60, an upper die support assembly 70, and an upper, inner, pre-lift punch assembly 80. In addition four sets of bearings are shown. They are a lower thrust bearing 91, a circumferential captured ball bearing race, or lower rotational bearing 92, an upper thrust bearing 93, and an upper rotational bearing 94.

As seen in the expanded view of Sheet 1 of 3 of FIG. 1, core rod 6 is a solid shaft which may be moved vertically along central axis 4, of press 2. Rod 6 may also comprise a radially extending spline 8, or splines, as desired. A single such spline with rectangular cross section may be used to form a keyway in the resultant part. Male spline 8 may as easily be a straight keyway or straight spur gear profile.

Inner lower transfer punch assembly 10 includes an inner lower transfer punch 11, having a radially extending flange 12, a retaining ring 14, and an inner pedestal 16 which may be vertically driven by a ram. Retaining ring 14 captures flange 12 against pedestal 16. In the preferred embodiment transfer punch 11, and indeed all of transfer punch assembly 10, is mounted concentrically about axis 4 in close tolerance sliding relationship about rod 6. Inner lower transfer punch 11 has an annular distal end face 17 perpendicular to, and concentric about, axis 4. In the preferred embodiment the external, outer face of transfer punch 11 is smooth in the vertical direction, having neither helical splines nor threads, but, as noted, under same circumstances an external spline, or spur gear profile could be used, in a manner similar to male spline 8 of core rod 6.

Outer lower punch assembly 20 includes an outer lower punch 21 having a radially extending flange 22, a support plate 24, a retaining ring 26, and a pair of driving rams 28 or a mechanical equivalent. Support plate 24 has a central passage 25 to allow outer lower punch assembly 20 to be disposed concentrically about inner lower punch assembly 10, and a cavity 27 to accommodate relative travel of inner lower transfer punch 11. As shown on the external scab view portion of outer lower punch 21, the distal end circumferential outer desired face 29 of outer lower punch has a helical gear profile corresponding to the profile of the final pan . Retaining ring 26 mounts to support plate 24 concentrically about axis 4 thus capturing flange 22 of lower outer punch 21. Lower outer punch 21 has an annular distal end face 23 perpendicular to and concentric with axis 4.

Lower die support assembly 30 is also carried concentrically about axis 4. It comprises a main plate 31, a bearing locating ring 32, a filler wear plate 33, and a bearing retainer 34 having an outer bearing race 35. Main bearing plate 31 comprises a counterbore 36 terminating at a radially inwardly extending shoulder 37. Lower die assembly 30 is mounted on rams 39. Those skilled in the an will recognize that rams 39, like rams 28, may actually be connecting rods driven by remotely located rams, not shown. In all cases the purpose of rams 39, or a mechanically equivalent substitute, is to control the position and motion of lower die assembly 30.

Lower die carrier 40 is also mounted concentrically about axis 4 and comprises a lower die 41 , a clamping ring 42, having blind holes 43 in which transfer pins 44 are fixedly located. Lower die 41 has an inner face 45 which has the negative profile of the helical gear part desired and is suited for close tolerance helically sliding engagement of the externally threaded gear profile of outer face 29 of lower outer punch 21. Lower die carrier assembly 40 also comprises a carrier base 46.

Bearing locating ring 32 is mounted upon shoulder 37 within bore 36, and serves as a radial retainer for a lower thrust bearing 91. Base 46 rests upon thrust bearing 91. Bearing retainer 34 is bolted to locating ring 32 to trap lower rotational bearing 92 between an inner bearing race 48 and outer bearing race 35, thus capturing base 46 and preventing vertical displacement of base 46 relative to main plate 31. A thick flange 47 of die 41 rests on base 46. Clamping ring 42 seats about die 41, capturing flange 47 as it is bolted to base 46. Filler wear plate 33 is mounted to main plate 31 about lower die carrier 40 to prevent wear of main plate 31 during repeated sweeping of powder metal.

From this description it follows that longitudinal relative motion between lower die 41 and lower outer punch 21 will necessarily be accompanied by a rotational component of motion, and that such longitudinal and rotational components of motion will prevail in all of lower die carrier 40 relative to lower outer punch assembly 20. Further, once clamping ring 42 is in place there is, ideally, no relative vertical motion between assembly 30 and carrier 40.

Upper die carrier 50 is also mounted concentrically about axis 4, and comprises an upper die 51; a main plate 52 into which die 51 seats; a bearing backing ring 53 to support main plate 52; at least one crank arm 54 mounted to, and at a location near the periphery of, main plate 52 and extending upwardly therefrom; a stub shaft 56*a* extending laterally from the distal end of crank arm 54; a roller 56 mounted in a conventional manner to rotate about stub shaft 56*a;* and a number of blind indexing holes 57 for intermittent enregistration of such torque transmitting stub shafts 44 as may protrude upwardly from assembly 40. An inner face 58 of die 51 carries the negative image of the helical gear face to be produced, but will be of an opposite hand to that of lower die 41. The outer circumferential face of backing ring 53 is provided with an inner bearing surface, or inner race 59 for engagement of bearing 94. Locking ring 55 is utilized to capture die 51 within plate 52.

Upper outer punch assembly 60, again concentrically mounted about axis 4, includes upper outer punch 61 having a radially extending flange 62; a pedestal 63*a* to which upper outer punch 61 is mounted when flange 62 is captured by a retaining ring 63*b;* a main platen 65 to which pedestal 63*a* is fixedly mounted; at least one depending cam 66 affixed to an outer portion thereof, depending cam 66 itself having a cam surface 67; a central passage 64*a* to accommodate pre-lift assembly 80; and at least two through passages 64*b* and 64*c* for accommodating upper die support assembly 70. As can be seen in FIG. 3, cam 66 depends in such a manner as to present cam surface 67 at a suitable radius from axis 4 to co-operate with roller 56, whose mutual interaction is more fully described hereinbelow. The downwardly extending, circumferential surface of outer upper punch 61 carries adjacent its distal end, a close tolerance mating male helical external profile 68 suitable for engagement with inner face 58 of upper die 51, again being oppositely handed to lower outer punch 21. Upper outer punch 61 comprises an annular, distal end face 69 perpendicular to axis 4.

As with lower die 41 and lower outer punch 21, longitudinal motion of upper die 51 relative to upper outer punch 61 is accompanied by a rotational component of motion about axis 4 by die 51 relative to upper outer punch 61. Although auto-rotating tool sets are encompassed in the present invention, in the preferred embodiment this rotational motion will be driven as main platen 65 moves downward relative to disc 71, and hence main plate 52 , due to the rotational impetus of the torque transferred to main plate 52 through crank 54 as roller 56 works along cam face 67. This may tend to reduce die friction, enhance die life, or reduce the shear imposed on the powder.

Similarly, the rotational motion of lower die 41 is imposed by the torque transferred by stub shafts 44 in close engagement with blind indexing holes 57. Thus the rotational motion of lower die carrier 40 is ultimately driven by the interaction of roller 56 and cam face 67. Thus matching rotation of both upper and lower assemblies of press 2 can be achieved with a single drive, giving a less complicated press.

Upper die support assembly 70, co-axially mounted about axis 4, includes a disc 1 having a thick, downwardly extending skirt 72; an upper circumferential outer bearing ring 73 depending from skin 72, bearing retaining ring 73 comprising on its inwardly facing surface an outer bearing retaining race 74 which co-operates with inner race 59 of backing ring 53 to contain bearing 94; and at least two symmetrical pistons 75 Fixedly abutting the upper surface, or base, of disc 71. As before, pistons 75 may be any mechanical equivalent of a piston, a ram or a connecting rod for controlling the reciprocating motion of upper die support assembly 70. disc 71 has a central aperture 79 through which pre-lift assembly 80, outer upper punch 61 and pedestal 63*a* are introduced and, in use, which aperture 79 accommodates the longitudinal reciprocating motion thereof. Downwardly extending skin 72 has an inner face 76 of a diameter chosen to surround in close tolerance upper thrust bearing 93, which seats therein and against the downwardly exposed inside face of the base of disc 71. The opposite, downward face of thrust bearing 93 engages the upward face of backing ring 53.

Upper inner pre-lift assembly 80 is disposed concentrically along axis 4 in the same manner as the other assemblies. It includes upper inner, or pre-lift punch 81, having a radially extending flange 82; a footing 83 against which pre-lift punch 81 is held in abutting relationship by a retaining ring 84; and piston 86 which abuts the opposite face of footing 83. Prelift punch 81 comprises a distal annular face 85 perpendicular to axis 4.

Upper die 51 and lower die 41 need not necessarily be of the same diameter; they need not be in phase, that is to say, the addendum of a tooth on one half may, for example, be aligned opposite the dedendum between teeth on the opposite side. It is nonetheless anticipated that the majority of pans manufactured by the instant apparatus and method will be opposed double helical, symmetrical, in phase gears, commonly referred to as herringbone gears.

Having thus enumerated the components of the tool set of the present invention, a tool set may be defined as comprising core rod 6, inner lower transfer punch 11, lower outer punch 21, lower die 41, upper die 51, upper outer punch 61 and pre-lift punch 81. As such the tool set comprises those pans which contact the powder, and which constitute the negative images of the faces of the compact eventually produced. The tool set need not always include a pre-lift punch, and, although uncommon, may not necessarily include a core rod.

The operation and interaction of the various assemblies will now be described with the aid of the series of FIGS. 3*a* through 3*f*.

FIG. 3*a* illustrates a filling position in which the upper and lower pans of press 2 are separated. Rod 6 is at its first position, and stands flush with the upper face of lower die 41. Inner lower transfer punch 11 is at its lowest, retracted position. Outer lower punch 21 is at its first, highest, extended position. Lower die 41 is at its First, highest position, which is also the reference position of zero degrees of rotation. A lower cavity 100 is defined by the annular pocket formed between rod 6 and lower die 41, that pocket having two depths, a deep inner portion above lower inner transfer punch 11, and a shallower portion above outer lower punch 21. A charge of metal powder of the desired alloy, indicated as "A" is loaded into cavity 100, and swept level as shown in FIG. 3*b*.

In FIG. 3*b* core rod 6 has been advanced, thereby preventing powder from entering the central passage in pre-lift punch 81, and then the upper assemblies, that is, upper die carrier 50, upper outer punch assembly 60, upper die support assembly 70, and upper pre-lift assembly 80, have been advanced in unison such that the lower face of upper die 51 abuts the upper, mating face of lower die 41 at a parting plane 'P' defined by these abutting faces. This advance is a question of relative motion, since it may be achieved by moving either the upper assemblies or lower assemblies, whether singly or both at once. In the embodiment shown the lower assemblies, that is inner lower transfer punch assembly 10, outer lower punch assembly 20, lower die support assembly 30, and lower die carrier 40, remain stationary while the upper assemblies 50, 60, 70 and 80 advance. Stub shafts 44 register within indexing holes 57. Disc 71 is at its maximum extension from platen 65. Roller 56 is at its first, zero degrees of rotation position relative to cam face 67. Upper die 51 is at its first, most extended position relative to upper outer punch 61. Upper inner, pre-lift punch 81 is at its maximum, extended position relative to platen 65. Upper cavity 102 is defined by the annular space between rod 6 and the inner face of upper die 61, the top of the cavity being stepped, a first step corresponding to the distal end face 85 of pre-lift punch 81, and the second, outer step corresponding to the distal end 69 of outer upper punch 61.

Transition from FIG. 3*b* to FIG. 3*c* is the step of transferring uncompressed powder to fill cavity 102 with powder transferred from cavity 100 as the volume of cavity 100 decreases due to the advance of inner lower transfer punch 11. In the embodiment shown inner lower punch assembly 10 remains stationary while rod 6 and all of assemblies 20, 30, 40, 50, 60, 70, and 80 advance downwardly together to a second, longitudinal, transfer position. Initially the relatively raised position of prelift punch 81 encourages powder to travel radially to fill the radial gear tooth extremities of dies 41 and 51. As the combined volume of cavities 100 and 102 decreases pressure builds against pre-lift punch 81 and it retracts relative to outer upper punch 61. The limit of this retraction is reached when footing 83 abuts main platen 65. Further downward motion of main platen 65 will carry prelift punch SI downward as well. In this position distal end 85 of pre-lift punch 81 is, in the preferred embodiment, flush with distal end 69 of outer upper punch 61. In other embodiments one may wish the ends of either of the aforementioned punches to impress a non-flat, or non-flush profile on the compacted powder, and it is not always necessary to incorporate a pre-lift punch. To this point there has been no relative longitudinal motion between upper outer punch 61 and upper die 51, and therefore no rotational motion. At the completion of the transfer step the combined volume of cavities loot and 1021 is more or less equal to the former volume of cavity 100 in the filling step illustrated in FIGS. 3*a* and 3*b*.

Transition from FIG. 3*c* to FIG. 3*d* represents the compaction step. Lower inner punch 11 remains stationary. Rod 6 and main platen 65 continue to move downwardly. Pistons 75 draw disc 71 to a second, partially displaced position, closer to platen 65. Consequently roller 56 is forced against, and along, cam face 67, rotating all parts of carriers 40 and 50 to a second, partially rotated position. This causes assembly 30 and carrier 40 (and, incidentally, 50) to move longitudinally downward relative to assemblies 10 and 20. For plane of abutment 'P' to remain constantly equidistant from the opposed end faces 23 and 69 of punches 21 and 61 the rate at which main platen 65 is driven downward must be twice the rate at which disc 71 is drawn toward main platen 65. A typical compaction process may reduce the combined volume of cavities 100 and 102 by about 50%, roughly doubling the density of the powder from its loose state to its compacted state.

At the second, partial, or mid-way position of travel of roller 56 along cam face 67 one reaches the position shown in FIG. 3*d*. The transition from FIG. 3*d* to FIG. 3*e* is the withdrawal step. Inner lower punch 11 and outer lower punch 21 remain stationary. Main platen 65 ceases to advance , and therefore outer upper punch 61 is stationary as well. Pistons 75 continue to withdraw disc 71 toward main platen 65. Consequently roller 56 continues to advance along cam face 67, forcing carriers 40 and 50 to a third, fully rotated position. Since upper outer punch 61 and outer lower punch 21 are stationary, and opposite-handed, the net effect is that dies 41 and 51 withdraw from each other like unwinding,, turnbuckle halves, causing cavities 100 and 102 to open and disappear, leaving a workpiece, indicated as 'B', exposed. As illustrated the resultant green form part, workpiece 'B', has the desired opposite-handed mating helical gear profiles of a herringbone gear.

As disc 71 withdraws lower assembly 40 will only continue to rotate as long as stub shafts 44 engage index holes 57. To that end the overlapping length of stub shafts 44 within index holes 57 exceeds the longitudinal travel of disc 71 relative to main platen 65 from the first position corresponding to zero rotation, to the third position, corresponding to full rotation.

The last step in the process, shown in FIG. 3*f*, is to eject the finished part by advancing punch 11. Once workpiece 'B' has been removed punch 11 may be withdrawn, and all other assemblies returned to the positions shown in FIG. 3*a* to await a subsequent charge of powder metal. The relationship of the helical threads of the dies 41 and 51 relative to punches 21 and 61 respectively ensures that roller 56 is once again positioned in the first, zero degrees of rotation position before the next cycle starts.

The process of operation of the preferred embodiment has been described with reference to the body of the press. It may also be described relative to the workpiece, or relative to a press whose upper and lower assemblies have equal and opposite motion relative to a fixed datum. In that case, the press would appear, in terms of relative motion to move from a first, transfer position in which dies 41 and 51 are in longitudinal (relative to axis 4) abutting relationship and the outer punches 21 and 61 are in a retracted, spaced apart relationship, a cavity 104, the sum of cavities 100 and 102, being formed within the space bounded peripherally by dies 41 and 51 and the punches 11, 21, and 61, and 81 if present. Punch 11 would appear to move relative to the plane of abutment 'P' of dies 41 and 51, which may be considered a longitudinal datum, to distribute powder throughout cavity 104.

In the compaction step, punches 11, 21, and 61, and 81 if present, appear to move equally toward the datum of plane 'P' to a second, advanced, spaced apart position while simultaneously rotating dies 41 and 51 through an angle along the helices of punches 21 and 61 between the retracted and advanced positions such that dies 41 and 51 are maintained in their abutting relationship.

In the withdrawal step, punches 21 and 61 appear stationary relative to datum plane 'P', and dies 41 and 51 continue turning to a fully rotated position, such as may be chosen, which causes them to separate.

In the preferred embodiment, taking the unrotated position as zero, the partially rotated position may be 300 and the fully rotated position may be 600. These values depend on the choices of helix angle and gear thickness.

In the foregoing example of the preferred embodiment it will be noted that only two assemblies, the upper and lower die carriers 50 and 40, respectively, are rotationally driven. As noted, they could be driven with independent numerically controlled motor drives or other means to provide a torque to overcome die friction. A cam system with transfer pins as shown is simple and reliable.

Drives are not necessarily required. Herringbone gears having a helical pitch angle less than 15 or 20 degrees and modest thickness may usually be made with auto-rotating dies. The likelihood of jamming and excessive wear of punches and dies increases as helical pitch angle increases. For helical pitch angles greater than 30 degrees a rotational drive is usually necessary. Between 15 and 30 degrees one may require tests to be conducted to determine whether auto-rotation will be satisfactory.

The preferred embodiment shown in FIGS. 3*a* through 3*f* can be used to make double opposed helical gears, whether in or out of phase, and whether of an equal number of teeth or not, and whether of similar diameter or not, provided that the upper and lower helical threads are of opposite hands and provided that the upper and lower dies 41 and 51 rotate through the same angle during compression. If dies 41 and 51 do not rotate through the same angle and if compression is not proportionate to the final upper and lower pan thickness above and below the die parting plane 'P' the powder charge is subject to shearing.

The preferred use of this embodiment is for making symmetrical, double opposed helical gears, or herringbone gears, shown in FIG. 6 as item 110 without a hub, and as item 115 with a hub. Other pans that can be produced with the tool set of FIGS. 3*a* through 3*f* are a split phase double opposed herringbone gear 120; opposed helices of differing number of teeth, but the same pitch angle, 125; an under-cut opposed double helical gear 130 having an upper gear of smaller diameter than the lower gear, and an overcut gear 135 having an upper gear of greater diameter than the lower gear; and asymmetrical double opposed helical gears having the same total angle of rotation, such as item 140.

Item 140, illustrated in FIG. 6, is a double helical gear with an upper gear portion 142 thrice as thick as the lower gear portion 144. During compression the relative advance of punch 61 in die 51 would also be thrice the relative advance of punch 21 within die 41 to maintain the neutral plane of the powder charge at, or near, parting plane 'P' of dies 51 and 41.

Combinations of the features of items 110,115, 120, 125, 130,135, and 140 are possible with the embodiment of FIGS. 3*a* through 3*f* provided that compression above and below plane 'P' is proportionate, and that the total angle of rotation of upper and lower dies is equal. Once a powder compact has been formed in the tool set, and ejected, it is sintered to yield a metal gear.

The present invention permits the fabrication of double helical gears having upper and lower gear portions, that are of substantially equal diameter or whose diameters vary by less than the sum of (a) the dedendum of the larger diameter gear portion, (b) the addenda of the smaller diameter gear portion, and (c) 2 millimeters.

The second embodiment of the invention, comprising the lower tool set pans illustrated in Sheet 3 of 3 of FIG. 1 combined with the upper tool set parts of sheet 2 of 3 of FIG. 1 is intended for making a wider range of parts than is possible with the preferred embodiment.

Referring first to sheet 3 of 3 of FIG. 1, lower outer punch assembly 20 has been modified to include a rotational drive, and as modified is shown as rotationally driven lower outer punch assembly 220. Outer lower punch 21, radially extending flange 22, retaining ring 26 and rams 28 remain as before. Outer lower punch 21 is supported by driven support plate 223, itself mounted on inner ring 224. The remainder of driven lower outer punch assembly 220 comprises retaining ring 225, main base 227, ball bearings 95, thrust bearing 96, a motor 97 and drive, such as a timing chain 98. Main base 227 is provided with an internal radially extending shoulder, or shelf, 221, on which thrust bearing 96 rests, surmounted in turn by inner ring 224, which is provided with an outward and upwardly facing ball race 222 for accommodating ball bearings 95. Retaining ring 225 is provided with a bearing race 226 and is located on main base 227 above ball bearings 95. When thus located inner ring 224 is trapped between ball bearings 95 and thrust bearing 96 and is thus, ideally, incapable of vertical reciprocation independent of main base 227, but permitted to rotate about axis 4 as may be desired. Motor 97 may be mounted to main base 227. In the figures motor 97 is shown, for convenience of drawing, in the plane of the drawing. in practical use motor 97 would be mounted out of the plane of the drawing to interfere least with vertical reciprocation of lower die support assembly 30, and specifically, not to interfere with rams 39.

Driven support plate 223 may carry a gear tooth profile 228 for engagement with timing chain 98, itself driven by a pinion 99 mounted to motor 97. Thus operation of motor 97 will cause rotation of driven support plate 223, and, consequently, lower outer punch 21.

Although a motor 97 has been shown, driven lower outer punch assembly 220 could be caused to turn in a number of ways. For gears of low pitch angle, and thin or moderate thickness, auto-rotation of lower outer punch 21 within lower die 41 as rams 28 are driven vertically relative to rams 39 may be suitable. Alternatively a motor, as shown, or a cam system, or other known mechanical or electromechanical device could be used to achieve equivalent friction counteracting torque and motion.

A typical operating sequence for the second embodiment of the tool set of the present invention is illustrated in FIGS. 4*a* through 4*f*, in this case to produce a green powder compact of strongly differing helical pitch angles. FIGS. 4*a*, 4*b* and 4*c* correspond to the filling and pre-compaction steps of FIGS. 3*a* , 3*b* and 3*c*.

During compaction lower outer punch 21 is driven in the appropriate direction at the appropriate speed to achieve the same vertical rate of compaction as upper outer punch 61 relative to parting plane 'P'. If dies 51 and 41 are not of equal depth lower outer punch 21 can be caused to rotate at an appropriate rate to achieve proportionate compaction above and below parting plane 'P'. For example, if it is desired to produce a lower gear of thrice the thickness of the upper gear, yet with an equal, opposite pitch angle, and diameter, lower outer punch 21 may be rotated through twice the angle of rotation of dies 41 and 51, and advanced thrice as far within lower die 41 as upper outer punch 61 is advanced within upper die 51.

In this embodiment relative rotation of distal face 23 of lower outer punch 21 to the lower face of powder charge 'A' precludes the introduction of keyways between inner lower punch 11 and outer lower punch 21, and limits the location of drive slots or eccentric features in the compacted pan in the region adjacent distal face 23. Similarly, distal face 23 must be of constant cross section at any given radius about axis 4, preferably flat, to avoid imposing excessive shear in the powder. In contrast to post-transfer relative rotation of upper and lower dies 51 and 41, rotation of lower outer punch 21 relative to the body of powder charge "A" is less likely to cause shearing of teeth at the interface of the upper and lower dies, or vice versa.

Similarly, asymmetric die withdrawal and ejection are possible. in a first phase of withdrawal the dies are withdrawn at the same rate of rotation until one die, for example die 51, clears workpiece 'B' at which time pins 44 also clear indexing holes 57, after which time in the second phase of withdrawal the other die, in the example die 41, can be rotated relative to punch 21 as desired to clear the remainder of workpiece 'B', and the part may be ejected. It is also possible that pins 44 do not clear indexing holes 57 at the start of the second withdrawal phase, in which case upper punch 61 would protrude through die 51. Upper punch 61 and upper die 51 may be retracted longitudinally away from workpiece 'B' between the first and second phases of withdrawal.

In addition, driving lower outer punch 21 rotationally permits one to form, in addition to items 110, 115, 120, 125, 130, 135, and 140, with appropriately configured die and punch gear profiles, a combination helical gear and spur gear 145, and gears having the same or different pitches and different thicknesses, 150. In each of these cases any of the gears produced may have the same or different numbers of teeth, and the same or different diameter, and may be in or out of phase. A spur gear profile is produced in the special case in which one helix angle is set at zero degrees.

It appears that the apparatus of the present invention may be used to make a gear having two helical gears of the same hand but different helix angles, as illustrated in item 160, but in that instance upper and lower die carriers 40 and 50 would, in the general case, apparently require independent rotational motions (i.e. autorotational or driven) without any interlink mechanism such as pins 44 and indexing holes 57. That is, it appears that two pan helical gears of the same hand but unequal pitch may be made by providing independent rotational motions to either (a) both dies and one outer punch or (b) one die and both outer punches. Drives for the independent rotational motions may be provided to reduce friction.

The two stage withdrawal may also be achieved, with independent rotation of upper and lower punches, in two completely separate phases. During the first phase upper die 51 is withdrawn along punch 61 until clear of workpiece 'B'. In the second phase lower die 41 is withdrawn along punch 21 to expose the part.

In the case of spur gear 145, with no rotation of dies and a rotating lower punch, the upper die is drawn upwardly away to expose the spur gear portion of workpiece 'B'. In the second phase of withdrawal lower punch 21 rotates as lower die 41 is withdrawn. in the case of asymmetric gears of the same hand, such as item 160, in which there is relative rotation between upper and lower dies 41 and 51, upper die 51 is withdrawn along punch 61, and subsequently lower die 41 is retracted along punch 21.

A press that involves three independent rotational motions, whether driven, or especially if auto-rotating, may be expected to be more difficult to produce than one requiring only two drives, and much more difficult than one requiring only a single rotational drive. In that regard while it appears possible to make item 160, the practical difficulties of constructing a suitable press, tool rig, (ie. hold all tool elements) and tool set may militate against its actual production, particularly as the helical pitch angle increases. This same cautionary- consideration might well be applied to a lesser extent to all gears more complex than the matched herringbone gears of the preferred embodiment. While the principles of the present invention appear to be theoretically applicable to any helical pitch angles, the practical range of the present invention is anticipated to be for angles less than 45 degrees, preferably in the range of 5 to 30 degrees. Helical gears having pitch angles in the range of 15 to 30 degrees are common. Gears with helical pitch angles in excess of 45 degrees are rare.

A third embodiment of a tool set, for producing double opposed helical gears, is shown in exploded form in FIG. 2. In this case, as will be described, neither of the upper or lower dies is mounted for rotation, whereas both upper and lower outer punches are rotatably mounted.

Lower outer punch assembly 220 is as described above. Lower die assembly 230 comprises a lower die 231, a die carrier or platen 232, a retainer 233, a filler wear plate 234, and rams 239, or equivalent. Lower die 231 is mounted in carrier 232, which is captured in place by retainer 233. Vertical reciprocation of lower die assembly 230 is controlled by driven rams 239 mounted to carrier 232. Notably, die 231 is unable to rotate relative to carrier 232 or rams 239, and is no longer provided with a drive mechanism or transfer pins. Die 231 has a negative helical gear profile 236 for mating with helical profile 29 of punch 21.

Upper outer die assembly 250 comprises upper die 251 mounted in upper die carrier 252, and locked in place with retaining ring 253. Rams 254 mounted to the upper face of upper outer punch assembly 250 control its vertical reciprocation.

Upper outer punch assembly 260 comprises an upper outer punch, 261, having a radially extending flange 262, a retaining ring 263, a support base 264, ball bearings 291, a thrust bearing 292, a capture ring 266, a disc 265 having depending capture ring 266, and platen 267 which may be mounted to rams, connecting rods, or other mechanical equivalents, not shown. A drive, shown as 297, has a timing chain 298 driven by a pinion 299. As before, drive 297, chain 298, and pinion 299 are shown for the convenience of drawing in the plane of sheet 2 of 2 of FIG. 2, but would, in practice, be disposed out of the plane of the page to avoid interference with the vertical reciprocation of other assemblies, such as upper die assembly 250, and in particular, rams 254. Upper die 251 has a negative helical gear profile for mating with a helical gear profile 268 of punch 261.

As before, although motor 297 and timing chain 298 are shown for rotationally driving lower outer punch 21 and upper outer punch 261, auto-rotation may be adequate in some circumstances, and alternative mechanically or electromechanically equivalent variations could be used.

This third embodiment of the invention can be used to form herringbone gear workpieces. The same restrictions to the use of splines, keyways, and eccentric features noted above apply to the third embodiment since both upper and lower punches may experience rotation with respect to the powder charge during compaction.

The steps of filling and transfer are much as before, as shown in FIGS. 5*a*, 5*b* and 5*c*. During the step of compaction experienced between FIGS. 5*c* and 5*d,* it is, as usual, desirable to discourage displacement of powder across parting plane 'P', by causing upper, lower, and transfer punches 21, 261, and 11 respectively, to advance simultaneously and proportionately relative to parting plane 'P'. In the usual case in which the volume of cavity 204 is reduced, more or less, 50% in volume, each of punches 21, 261, and 11 will advance to half its former distance from plane 'P'. The rates and relative displacement of the punches will be proportional to the relative thicknesses of the upper and lower helical gear portions of eventual workpiece 'B'. As before, the motion is relative motion, since parting plane 'P' may move relative to the stationary press.

For example, if the desired final thickness of the lower helical gear ($T_L$) is 2.0 cm and its diameter ($D_L$) is 1.5 cm, and the final desired thickness of the upper helical gear ($T_H$) is 1.0 cm and its diameter ($D_H$) is 2.5 cm, then the transfer step will end with the opposing distal face 270 of upper outer punch 261 6 cm apart from distal face 23 of lower outer punch 21, with face 270 2 cm above plane 'P', and face 23 4 cm below plane 'P'.

During compaction the relative vertical advance of upper outer punch 261 must be half that of lower outer punch 21, and must occur at half the rate. For the gear profiles chosen this proportionate advance will dictate the angle and rate of rotation necessary for the upper and lower outer punches. For example, if the chosen lower helix angle is 15° and upper chosen helix angle is 45° then the upper outer punch 261 must rotate (1/2)(1.5/2.5)(TAN 45°/TAN 15°) times as far, and as fast, as lower outer punch 21.

During the withdrawal step, since the dies do not rotate, workpiece 'B' must rotate as dies 231 and 251 separate or the teeth of workpiece 'B' will be torn off. For herringbone gears, upper die 251 and lower die 231 will clear the respective upper and lower portions of workpiece 'B' more or less simultaneously. For an asymmetric gear in which $(T_H/T_L)$ $(D_L/D_H)$ $(\mathrm{TANO}_H/\mathrm{TAN}\ \mathrm{O}_L)=1$ one die will clear before the other. In that case one die may stop moving, or both punches may continue moving until the second die also clears workpiece 'B'.

The withdrawal step may then be said to be sub-divided into a lust gear clearing portion, in which punches 261 and 21 rotate through an equal angle relative to dies 231 and 251 to disengage a First die from workpiece 'B', and a second gear clearing portion in which workpiece 'B' and at least one of punches 261 or 21 rotate relative to the die, 231 or 251, which continues to engage workpiece 'B' until that die also clears workpiece 'B'.

The third embodiment of the invention, can be used to make herringbone gears and opposite handed gears. Examples of the gears which may be produced with the third embodiment include items 110, 115, 120, 125, and 130. In the event that the upper and lower punches are permitted to rotate independently of each other one can also form items 135 and 140. Item 145 can be produced with non-rotating dies and a single rotating, lower punch using a two stage withdrawal in which the upper assemblies of the press are withdrawn first to expose the spur gear.

Thus one embodiment of the present invention includes a tool set for making double helical gear green powder compacts, that tool set comprising a lower punch 21 having a first helical gear profile 29 and a lower die 41 having a mating negative helical profile 45 for helically sliding engagement with punch 21, an upper, opposed punch 261 having a second helical profile 268 from punch 21, an upper die 251 having a mating negative helical profile 268 for helically sliding engagement with punch 261, punch 261 disposed in opposition to punch 21 and dies 41 and 251 movable to abut at a parting plane 'P'.

The present invention may further include, as installed in a multiply-acting press having an axis 4 of reciprocation, a core rod 6 and a transfer punch 11, punch 21 being concentric with transfer punch 11 and having a distal end face 23 for contacting a charge of powder 'A', upper punch 261 concentric with axis 4 and having a distal end face 270 for contacting that charge of powder 'A', the tool set movable to a filling position for receiving that charge of powder; a closed position in which dies 41 and 251 define the periphery of a cavity 104 having an upper portion bounded by die 251 and a lower portion bounded by die 41; a transfer position; a compaction position; at least one withdrawal position; and an ejection position.

In this invention helical gear profile 29 may be of the same hand or opposite hand as second helical gear profile 268 and chosen from the group of helical gear profiles that are at least one of a) out of phase with; b) of different diameter from; c) of different helical pitch from; d) of a differing number of teeth from; or e) of a different helical tooth profile from, helical gear profile 268. In addition, the tool set may include a set of as many as three drives chosen from a) a first drive for independently rotating upper die 251, a second drive for independently rotating upper punch 261, and a third drive for independently rotating lower punch 21; or b) a first drive for independently rotating upper die 251, a second drive for independently rotating lower die 41, and a third drive for independently rotating one of i) lower punch 21 or ii) upper punch 261.

This invention may further include a method for making double helical gear powder compacts with the tool set described above in a multiply acting powder press, that method including a) filling that cavity lower portion with a charge of powder 'A'; b) displacing dies 41 and 251 to abut at parting plane 'P'; c) displacing transfer punch 11 to distribute metal powder throughout cavity 100; d) compacting the charge of powder to form a green compact by advancing upper and lower punches 261 and 21 simultaneously and proportionately toward plane 'P' while upper punch 261 rotates relative to die 251 and lower punch 21 rotates relative to die 41; e) withdrawing one of (a) die 251 by retracting it along upper punch 261 while rotating die 251 along helical profile 268; or (b) die 41 by retracting it along lower punch 21 while rotating die 41 along helical profile 29, to a first withdrawal position in which that die clears compact 'B'; f) withdrawing the other die by retracting it along the other punch while rotating it along the helical profile of the other punch, to a second withdrawal position in which that other die clears the compact 'B'; and g) ejecting compact 'B'.

The same invention may be practiced with helical gear profile 29 being of opposite hand to helical gear profile 270, with or without a set of drives chosen from a) a first drive for independently rotating die 251, a second drive for independently rotating punch 261, and a third drive for independently rotating punch 21; or b) a first drive for independently rotating die 251, a second drive for independently rotating die 41, and a third drive for independently rotating one of i) punch 21 ii) punch 261.

The invention may be practiced with a tool set in which dies 41 and 251 are constrained to have the same angular orientation about the axis, and the tool set may include drives chosen from a) a first drive for rotating die 251 and die 41 together, and a second drive for independently rotating one of i) punch 261 or ii) punch 21; or b) a first drive for independently rotating punch 261 and a second drive for independently rotating punch 21, in which case one may use a method for making asymmetric double helical gear green powder compacts of the same hand, that method comprising the steps of a) filling cavity 104 lower portion with a charge of powder 'A'; b) displacing dies 41 and 251 to abut at plane 'P' with said opposing distal end faces 23 and 270 proportionately distant from plane 'P'; c) displacing transfer punch 11 to distribute the charge of powder 'A' throughout cavity 100; d) compacting charge of powder 'A' to form a green powder compact B' by advancing punches 261, 21, and 11 proportionately toward plane 'P' while punch 261 rotates relative to die 251 and punch 21 rotates relative to die 41; e) withdrawing both of i) die 251 along punch 261, and ii) die 41 along punch 21, during rotation of dies 41 and 251 relative to punches 21 and 261, and relative to compact B', to a first withdrawal position in which one of dies 41 or 251 clears compact 'B'; f) withdrawing the other die along its mating punch, to a second withdrawal position in which it also clears compact 'B', and ejecting compact 'B'.

The invention may also be practiced with a tool set in which dies 41 and 251 are constrained to maintain a fixed angular orientation relative to axis 4.

In another embodiment the invention includes a tool set for making herringbone gear green powder compacts, that tool set comprising a first punch 21 having a helical gear profile 29, a first die 231 having a mating negative helical profile for helically sliding engagement with punch 21; a second, opposed punch 261 having an equal, opposite handed helical profile 268; a second die 251 having a mating negative helical profile for helically sliding engagement with punch 261; dies 231 and 251 movable to abut at parting plane 'P'. That tool set may be installed in a multiply acting press having an axis 4, and may further comprise a core rod 6 concentric with axis 4 and a transfer punch 11 concentric therewith; punch 21 concentric with punch 11 and having a distal end face 29 for contacting a charge of powder 'A'; punch 261 concentric with axis 4 and having a distal end face 270 for contacting powder; the tool set movable to a filling position for receiving charge of powder 'A'; a closed position in which dies 231 and 251 define the periphery of a cavity 104, that cavity having an upper portion bounded by upper die 251 and a lower portion bounded by die 231; a transfer position; a compaction position; at least one withdrawal position; and an ejection position. In one embodiment dies 231 and 251 are constrained to have the same angular orientation relative to axis 4 and punches 261 and 21 are constrained to have a fixed angular orientation relative thereto. Conversely, punches 261 and 21 may have the same angular orientation relative to axis 4 and dies 231 and 251 may be constrained to have a fixed angular orientation relative thereto. In either case the tool set may include a drive for rotating dies 231 and 251 relative to punches 261 and 21.

In one embodiment an upper die 51 is carried in an upper die carrier 50 and lower die 41 is carried in a lower die carrier 40, one of the upper or lower die carriers having registration sockets, or holes 57 and the other of said upper die carrier or said lower die carrier comprising transfer pins, or stub shafts 44, for registration therein; and the drive may comprise a cam mounted fixedly to one of upper punch 61 or upper die carrier 50; and a cam follower, for example roller 56, linked to the other; the cam follower disposed to ride along the cam whereby displacement between the upper punch 61 and upper die carrier 50 compels the cam follower to ride along the cam and compels dies 41 and 51 to rotate relative to upper punch 61.

The tool set is movable to a filling position for receiving a charge of powder metal 'A'; a transfer position; a compaction position; and a withdrawal position. In the transfer position dies 41 and 51 are disposed in longitudinally abutting, unrotated relationship; punches 21 and 61 are in a first, retracted, opposed, spaced apart relationship; whereby cavity 104 for containing the powder metal charge 'A' is defined longitudinally by opposed faces 23 and 69 and peripherally by dies 41 and 51; in the compaction position punches 21 and 61 are in a second, advanced, opposed, spaced apart relationship, dies 41 and 51 remaining in abutting relationship; then dies 41 and 51 are moved to a partially rotated position whereby cavity 104 is reduced in size to compact powder charge 'A'; and in the withdrawal position punches 21 and 61 remain in the advanced, opposed, spaced apart relationship; and dies 41 and 51 are disposed in a fully rotated position whereby moving dies 41 and 51 to the fully rotated position causes them to separate and to expose a compressed workpiece 'B'.

The tool set may have a pitch drive for coordinating rotation of dies 41 and 51 during longitudinal translation of punches 21 and 61, the pitch drive receiving mechanical input from the motion of punch 21 or 61 and providing output to die 41 or 51; that pitch drive may be a cam and roller mechanism with one of a) a cam or b) a roller in rigid structural relationship to one of lower or upper punches 21 or 61; the other being in rigid structural relationship with the corresponding lower or upper one of dies 41 or 51, whereby longitudinal translation of that punch relative to that die compels rolling engagement of the roller and cam, yielding consequential rotation of the die relative to the punch. Dies 41 and 51 may be constrained to rotate conjointly.

The invention includes a method for making herringbone gear powder compacts using that tool set in a multiply acting press, that method comprising a) filling a lower portion of cavity 104 with a charge of powder 'A'; b) displacing dies 41 and 51 to abut at parting plane 'P' with opposing distal end faces 69 and 23 of punches 21 and 61 proportionately distant from said plane 'P'; c) displacing transfer punch 11 to distribute the charge of powder throughout cavity 104; d) compacting charge of powder 'A' to form a compact 'B' by advancing punches 21 and 61 equally, and transfer punch 11 proportionately, toward parting plane 'P' while dies 41 and 51 rotate equally relative to punches 21 and 61; e) withdrawing both of i) die 51 along punch 61, and ii) lower die 41 along punch 21, during equal relative rotation of dies 41 and 51 relative to punches 21 and 61 and compact 'B', to a first withdrawal position in which dies 41 and 51 clear compact 'B'; and f) ejecting compact 'B'.

The above embodiments have shown gears with external teeth. As shown in FIGS. 7 to 17 similar principles may also be used to produce gears with internal teeth.

Although a number of embodiments have been described herein for practicing the present invention, those skilled in the art will recognize that the principles of the invention are not limited to specific embodiments herein but apply also to equivalents thereof.

Referring therefore to FIG. 7, an internal herringbone gear 1010 has a body 1012 with a peripheral outer surface 1014 and a toothed radial inner surface 1016. The inner surface 1016 is formed in two sets of dissimilar gear teeth 1018, 1020. In the example shown in FIG. 7, the gear teeth 1018, 1020 are of equal but opposite helix angle and of similar diameter although it will be appreciated that other configurations of teeth sets 1018, 1020 can be utilized, including combinations of helical gears and straight gears, or two helical gears of the same hand but different helix angle.

The component 1010 is formed from a powdered metal charge that is formed under pressure into the finished shape in the tool set 1022 shown in FIGS. 8 through 12. The nature of the metal charge and its subsequent processing into a finished component is well known in the art of powdered metallurgy and therefore need not to be described further at this time.

The tool set 1022, shown in an open position in FIG. 8, includes a die assembly 1024 and upper and lower punch sets 1026, 1028. The tool set 1022 is used in combination with a multi stage hydraulic press of known construction. The drive cylinders associated with the press are shown schematically as hydraulic actuators in the drawings, but it will be appreciated by those skilled in the art that the configuration and drives for such a press will vary according to the particular press utilized. The punch sets 1026, 1028 and die assembly 1024 are displaceable relative to one another along the longitudinal axis indicated A—A under the control of the press.

The die assembly 1024 includes a support 1030 whose position is controlled by a press cylinder 1032. The support 1030 locates a die 1034 having an inner surface 1036 conforming to the shape of the outer surface 1014 of the component 1010. The die 1034 is located by a keeper plate 1038 in a well-known manner so as to be readily removable from the support 1030.

The upper punch set 1026 includes an outer support 1040 whose position is controlled by a press cylinder 1042. An outer punch 1044 is retained by a clamping ring 1046 on the lower face of the support 1040. The outer punch 1044 has an outer surface 1048 conforming to the radially inner surface 1036 of the die 1034 so as to be a snug sliding fit within the die, and a radially inner surface 1050 that has a thread form corresponding to the teeth 1018 on the component 1010.

A core rod 1060 is received in the outer punch 1044 and has a threaded outer surface 1062 complementary to the inner surface 1050 of the outer punch 1044. The core rod 1060 depends from a housing 1063 that is rotatably mounted by bearings 1064, 1066 on a mounting block 1068. The block 1068 is displaceable relative to the housing 1040 under the influence of a press cylinder 1070. An insert 1072 is located within the core rod 1060 and is rotatably supported by a bearings 1074 so as to be freely rotatable relative to the core rod. The end face 1076 of the core rod 1060 is recessed from the end faces 1078, 1080 of the insert 1072 and outer punch 1044 respectively.

The lower punch set 1028 is similar in construction to the upper punch set 1026 and includes an outer punch 1082 and a core rod 1084. The outer punch 1082 has a radially outer surface 1086 that is a sliding fit within the die 1034 and a radially inner surface 1088 having a thread form corresponding to the teeth 1020 on the component 1010. The outer punch 1082 is secured a lower support 1090 whose axial position is controlled by a press cylinder 1092.

The core rod 1084 has an outer surface 1094 complementary to the thread form 1088.

The core rod 1084 is secured to a housing 1096 which is rotatably supported on bearings 1098, 1100 on a support column 1102. The axial position of the column 1102 is controlled by a press cylinder 1104.

The tool set 1022 is initially positioned as shown in FIG. 2 with an end face 1106 of the lower core rod 1084 flush with the upper surface 1108 of the die 1034. The outer punch 1082 is withdrawn relative to the core rod 1082 so that end face 1110 is below the end face 1108 of the die 1034. A cavity 1112 is thus formed to receive a charge of metallic powder. The relative position of the inner and outer punches is carefully controlled to provide the requisite volume for the cavity 1112 with the flush surfaces 1106, 1108 facilitating filling of the cavity with the charge.

After charging, the tool set 1022 is moved to the configuration shown in FIG. 9. The die assembly 1024 is displaced slightly axially by the press cylinder 1032 so that the upper surface of the charge is recessed below the upper surface 1108 of the die 1034. The upper punch set 1026 is lowered by press cylinder 1042 so that the outer punch 1048 is received within the die 1034. In this position, the end face 1106 of the lower core rod 1084 abuts the end face 1078 of the insert 1072 and the end face 1080 of the upper outer punch 1044 is aligned with the end face 1106 of the core rod 1084. The cavity 1112 is thus closed with a slight clearance provided between the end faces 1076, 1106 of the core rods 1060,1084.

The press cylinder 1070 is then extended and press cylinder 104 retracted to displace the core rods 1060, 1084 axially relative to the die 1034. The axial displacement of the core rods 1060, 1084 induces rotation relative to respective ones of the outer punches 1044, 1082. At the same time there is relative rotation between the core rods themselves, depending upon the relative configurations of the tooth sets 1018, 1020, which is accommodated by the insert 1072 and the clearance between the end faces 1076, 1106. In the example shown, the gears 1018, 1020 are of similar diameter and equal but opposite helix angle so that the punches 1060, 1084 are of similar diameter. The punches thus contra rotate as they are displaced axially.

The core rods are displaced axially until they are located within the cavity 1112 in the correct proportion so that thread forms corresponding to each of the tooth sets 1018, 1020 are presented to the charge in the cavity 1112. The charge in cavity 1112 is then compressed by relative axial displacement between the outer punches 1044,1082. Conceptually, the end faces 1080, 1110 are driven toward one another by the press cylinders 1042, 1092 and in practice a controlled axial displacement of the die assembly 1024, core rods 1060, 1084 and upper outer punch 1044 is provided by the respective press cylinders whilst the lower outer punch 1082 remains stationary. The relative displacement continues until the final dimensions of the component 1010 are attained in the cavity 1112 as shown in FIG. 4. During this displacement, the core rods auto rotate relative to their respective outer punches as accommodated by the bearings, 1064, 1066 and 1098, 1100 with relative rotation between the core rods being accommodated by the insert 1072.

Once compressed, the die assembly 1024 is retracted by the press cylinder 1032 and the upper punch set retracted by the cylinder 1042. The component 1010 is thus exposed and available for removal. To facilitate removal of the component the die 1034 is initially withdrawn axially by the cylinder 1032 whilst the compact is supported by the end faces 1080,1110 of the respective outer punches 1044, 1082. The core rods 1060, 1084 are then withdrawn whilst the outer punches 1044, 1082 support the compact and the upper punch set 1026 then raised to expose the compact. The initial withdrawal of the die permits a limited radial spring back of the molded component to facilitate removal of the core rods 1060, 1084.

The tool set 1022 offers careful control over the finished component and ensures that the threaded formations used to define tooth sets 1018, 1020 remain engaged during filling and ejection of the component.

A further embodiment of tool set is shown through FIGS. 13 through 17 in which like components will be indicated with like reference numerals with a suffix 'a' added for clarity. As many of the components are identical only those specifically referred to will be identified in the drawing.

As may be seen from FIG. 13, the lower punch set 1028*a* includes a core rod 1084*a* that engages with a thread form on threaded outer punch 1082*a*. A supplementary outer punch 1120 is interposed between the outer punch 1082*a* and the radial wall 1036*a* of the die 1034*a*. The supplementary punch 1120 is supported on column 1122 whose axial position is controlled by press cylinder 1124.

In the fill position shown in FIG. 13, the supplementary punch 1120 is retracted relative to the outer punch 1082a to provide an enlarged cavity 1112*a*. After filling, the cavity is closed by adjustment of the die assembly 1024*a* and upper punch set 1026*a* as shown in FIG. 14 and the core rods then adjusted as shown in FIG. 15 to present a portion of each thread form 1062*a,* 1094*a* to the cavity 1112*a*. During the adjustment, the axial position of the supplementary punch 1120 is adjusted by the press cylinder 1124 to move flush with the end face 1110*a* of the outer punch 1082*a*. As this occurs the relative position of the core rod 1084*a* and outer punch 1082*a* remains fixed and the powder contained in the recess between a supplementary punch 1120 and the outer punch 1082*a* is displaced to fill the void created by the extension of the core rod 1060*a* of the upper punch set 1026*a*. Thereafter, the charge is compressed as shown in FIG. 16 and ejected as shown in FIG. 17 as with the previous embodiment.

Again it will be noted that the engagement and disengagement of the upper punch set to permit filling and ejection occurs without disengagement of the thread forms so that the accuracy of those thread forms is preserved. Similarly the core rods and die may be removed whilst the component is fully supported by the outer punches.

I claim:

1. A method of forming from a powdered metal charge an annular gear having a pair of sets of teeth formed on an axially extending wall, said method comprising the steps of:

a) defining a mold cavity containing said powdered metal charge and delimited by an axial wall formed from a first pair of relatively moveable members each having a thread form complementary to a respective one of said sets of teeth and a pair of axially spaced radial walls formed by a second pair of relatively moveable members interconnected to respective ones of said first members by thread forms corresponding to respective ones of said sets of teeth, b) compressing said powdered metal charge between said radial faces by axially displacing said second members toward one another to form a compact having each of said thread forms molded thereon, c) withdrawing said first members from said cavity whilst following respective ones of said thread forms on said compact and d) removing said compact from between said radial faces.

2. A method according to claim 1 wherein at least one of said first members is withdrawn by displacing it axially relative to the respective one of said second members.

3. A method according to claim 1 wherein said first pair of members are dies and said axial wall is radially inwardly directed.

4. A method according to claim 3 wherein said second members are punches.

5. A method according to claim 1 wherein said first and second members are axially displaceable to facilitate deposition of said charge in said cavity.

6. A method according to claim 5 wherein said first pair of members are dies and said second pair of members are punches, said charge being deposited in a chamber formed between one of said punches and its respective die.

7. A method according to claim 6 wherein said dies are subsequently closed to define said mold cavity and relative movement between said one punch and its respective die distributes said charge within said cavity.

8. A method according to claim 7 wherein said charge is compressed between said punches to form a compact by movement of said punches toward one another, cooperation between said interengaging threads controlling relative rotation between said punches and said dies.

9. A method according to claim 8 wherein said compact is removed from said cavity by movement of said dies away from one another, said punches being maintained stationary to control rotation of said dies relative to said punches and cause said dies to follow said thread forms.

10. A method according to claim 9 wherein said punches are retracted after separation of said dies to release said compact.

11. A method of forming an annular gear having a radially inwardly directed circumferential wall with a pair of sets of teeth formed thereon from a powdered metal charge said comprising the steps of a) defining a mold cavity containing said powdered metal charge between a die and a pair of punch sets each having a punch and a core rod interconnected by a thread form corresponding to a respective one of said sets of teeth, b) positioning each of said core rods to project axially from the respective punch to expose a portion of each of said thread forms within said cavity, c) compressing said powdered metal charge between said outer punches by axially displacing said punches relative to one another to form a compact having each of said thread forms molded thereon, d) withdrawing said core rods from said cavity whilst following respective ones of said thread forms on said compact and e) removing said compact from said die.

12. A method according to claim 11 wherein at least one of said core rods is withdrawn by displacing it axially relative to the respective punch.

13. A method according to claim 12 wherein each of said core rods is withdrawn by relative displacement between respective ones of said core rods and punches.

14. A method according to claim 13 wherein each of said thread forms has a helix angle less than 90° and said punch and core rod rotate relative to one another upon withdrawal of said core rod.

15. A method according to claim 11 wherein one of said punch sets is inserted in said die to define an open cavity and said charge is placed in said cavity prior to the other of said punch sets being inserted into said die.

16. A method according to claim 15 wherein said core rod of said one punch set axially projects from said punch prior to placing said charge.

17. A method according to claim 16 wherein an end face of said core rod projects to the upper surface of said charge in said die.

18. A method according to claim 17 wherein said end face of said core rod and an end face of said die are level with said upper surface of said charge.

19. A method according to claim 17 wherein an end face of said core rod of said other set abuts said end face of said core rod of said one set upon insertion of said other punch set into said die.

20. A method according to claim 16 including the steps of aligning said end face of said core rod of said one set and said end face of said die and filling said cavity with said charge up to said end faces.

21. A method according to claim 20 including the step of axially displacing said die relative to said one punch set to offset said end face of said die from the upper surface of said charge and subsequently inserting said other punch set into said die.

22. A method according to claim 21 wherein end faces of said core rods are brought into abutment upon insertion of said other punch set.

23. A method according to claim 22 wherein each of said core rods are moved axially relative to respective ones of said punches to position a portion of each of said thread forms in said cavity.

24. A method of forming from a powdered metal charge an annular gear having a radially inwardly directed circumferential wall with a pair of dissimilar sets of teeth formed thereon comprising the steps of:

a) providing a die and a first punch set within said die, said punch set including a punch and a core rod relatively rotatable and interconnected by a thread form corresponding to one of said sets of teeth, b) positioning said first core rods relative to said die to define a chamber to contain said charge and radially delimited by said core rod of said first punch set, to present a thread form to said chamber, c) inserting a second punch set into said chamber, said second set having a punch and a core rod to expose a portion of each of said threads forms in said chamber, d) Rotating said punches relative to respective core rods to move said core rods toward one another and to compress said charge in said chamber to form a compact, e) Rotating said core rods relative to respective ones of said punches to move said core rods away from one another to withdraw said core rods from said compact and permit removal thereof from said die.

25. A method according to claim 24 wherein said step of positioning said core rods includes rotating each of said core rods relative to respective ones of said punches to displace said core rods conjointly relative to said die.

26. A method according to claim 24 wherein said step of positioning said first punch set includes aligning an end face of said core rod with an end face of said die.

27. A method according to claim 26 including the step of placing said powdered metal charge in said chamber prior to insertion of said second punch set.

28. A method according to claim 24 wherein said die is removed from said compact prior to removal of said core rods.

* * * * *